US006942327B2

(12) United States Patent
Suzuki et al.

(10) Patent No.: US 6,942,327 B2
(45) Date of Patent: Sep. 13, 2005

(54) INK CARTRIDGE

(75) Inventors: Tsuyoshi Suzuki, Aichi-ken (JP); Toyonori Sasaki, Aichi-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/776,589

(22) Filed: Feb. 12, 2004

(65) Prior Publication Data

US 2004/0160497 A1 Aug. 19, 2004

Related U.S. Application Data

(62) Division of application No. 10/256,067, filed on Sep. 27, 2002, now Pat. No. 6,802,601.

(30) Foreign Application Priority Data

Jul. 23, 2002 (JP) ..... 2002-214079

(51) Int. Cl.[7] ..... B41J 2/175
(52) U.S. Cl. ..... 347/86
(58) Field of Search ..... 347/85, 86, 87, 347/108; 141/2, 88, 326, 329

(56) References Cited

U.S. PATENT DOCUMENTS

| | | | | |
|---|---|---|---|---|
| 4,183,031 A | * | 1/1980 | Kyser et al. | 347/86 |
| 4,630,077 A | | 12/1986 | Berruti et al. | |
| 5,721,576 A | | 2/1998 | Barinaga | |
| 5,732,751 A | | 3/1998 | Schmidt et al. | |
| 5,929,883 A | * | 7/1999 | Gunther et al. | 347/85 |
| 6,022,102 A | | 2/2000 | Ikkatai et al. | |
| 6,164,770 A | | 12/2000 | Takata | |
| 6,170,937 B1 | | 1/2001 | Childers et al. | |
| 6,276,788 B1 | * | 8/2001 | Hilton | 347/86 |
| 6,289,654 B1 | | 9/2001 | Yamaguchi et al. | |
| 6,332,481 B1 | * | 12/2001 | Shinada et al. | 141/18 |
| 6,338,552 B1 | | 1/2002 | Sato et al. | |
| 6,520,630 B1 | | 2/2003 | Oda et al. | |
| 6,582,068 B2 | * | 6/2003 | Ishizawa et al. | 347/85 |
| 2001/0052370 A1 | | 12/2001 | Shinada et al. | |
| 2002/0093556 A1 | | 7/2002 | Ishizawa et al. | |

FOREIGN PATENT DOCUMENTS

| | | |
|---|---|---|
| EP | 0 795 409 A1 | 9/1997 |
| EP | 0 864 428 A2 | 9/1998 |
| JP | A 3-505999 | 12/1991 |
| JP | B2 3025226 | 1/2000 |
| JP | A 2000-301731 | 10/2000 |
| WO | WO 90/00976 | 2/1990 |

* cited by examiner

*Primary Examiner*—Anh T. N. Vo
(74) *Attorney, Agent, or Firm*—Oliff & Berridge, PLC

(57) ABSTRACT

An ink cartridge is provided with a housing defining a body of the cartridge, an ink reservoir accommodated in the housing, an opening formed on the housing. The opening communicates with the ink reservoir through a fluid path. The cartridge further includes a stop to be tightly fitted in the opening. The stop has an elasticity, and is configured such that a hollow needle can be penetrated therethrough. A hole formed on the stop by penetration of the hollow needle is closed by the elasticity of the stop after removal of the same. A valve structure is provided to a part of the stop, the valve structure selectively opens and closes the communication between the opening and the ink reservoir through the fluid path.

24 Claims, 16 Drawing Sheets

INK CARTRIDGE

This is a Divisional of application Ser. No. 10/256,067 filed Sep. 27, 2002, now U.S. Pat. No. 6,802,601. The entire disclosure of the prior applications is hereby incorporated by reference herein in its entirety.

BACKGROUND OF THE INVENTION

The present invention relates to an ink cartridge to be coupled to a device using ink.

Conventionally, ink cartridges have been widely used in devices using ink. An example of such devices, an inkjet printing device has been known. The inkjet printing device typically includes an inkjet head, which has an ink nozzle. The ink nozzle is driven to eject ink drops toward recording medium such as a piece of paper to form images and characters thereon. Typically, the ink cartridge includes an ink reservoir, and the ink accommodated in the reservoir is supplied to the inkjet head.

The exchangeable ink cartridge is advantageous in that when the printer runs out of the ink, only by replacing the old cartridge with a new cartridge. Therefore, the exchangeable ink cartridge is widely employed.

A typical structure of the ink cartridge is configured such that an ink reservoir is formed inside a housing of the cartridge, and an opening formed on the housing. The reservoir is connected with a communication path, and the opening is sealed with a stopper such as a rubber stopper.

The device, to which the ink cartridge is to be coupled, is formed with an ink cartridge bay, where a hollow needle is projected at a position corresponding to the rubber stopper. When the ink cartridge is coupled to the cartridge bay, the hollow needle penetrates through the rubber stopper so that the ink can be sucked via the communication path and the hollow needle and supplied to the device.

In a case of an inkjet printer, the hollow needle is connected with an inkjet head through an ink feed tube so that the ink is supplied from the ink cartridge to the inkjet head.

If air or impurities invade inside the reservoir, bubbles of the air and/or the impurities are supplied to the device together with the ink, which may cause trouble. For example, if the device is an inkjet printer, and if the bubbles are supplied to the printer, some dots may not be formed since drops of ink is not jetted due to the bubbles. The impurities supplied to the printer may block up the ink nozzles.

Therefore, a structure which is capable of preventing the air and impurities from invading in the device when the ink is supplied from the replaceable ink cartridge to the device is desired.

However, in view of manufacturing such an ink cartridge, it is desired that an operation for filling the reservoir with the ink is relatively easy. Further, once the reservoir is filled with the ink, invasion of the air and/or impurities should be blocked without fail.

SUMMARY OF THE INVENTION

In view of the requirements described above, the present invention is advantageous in that it provides an ink cartridge, which includes a housing defining a body of the cartridge, an ink reservoir accommodated in the housing, an opening formed on the housing, the opening communicating the ink reservoir through a fluid path, a stop to be tightly fitted in the opening, the stop having elasticity, the stop being configured such that a hollow needle can be penetrated therethrough, a hole formed by penetration of the hollow needle being closed by the elasticity of the stop after removal of the hollow needle, and a valve structure provided to a part of the stop, the valve structure selectively opens and closes the communication between the opening and the ink reservoir.

With this configuration, the ink can be supplied to the ink reservoir easily through the hollow needle. After the ink supply is completed, the valve structure is closed so that the ink does not flow from the ink reservoir to the opening and/or bubbles of the air and impurities do not enter from the opening to the ink reservoir. It should be noted that the stop also has a sealing effect to block the communication between both sides thereof.

Optionally, the valve structure may be configured to selectively open and close the communication between the opening and the ink reservoir depending on a positional condition of the stop.

In some embodiments, the positional condition includes a position along an axis of the stop. Alternatively, the positional condition may include a rotational position of the stop.

In one embodiment, the fluid path communicates with the opening at a decentered position of a bottom surface the opening.

In a particular case, the valve structure may include a protrusion that is protruded from a bottom surface of the stop at a position corresponding to the decentered position where the opening communicates with the fluid path. With this configuration, the protrusion is fitted in the fluid path when the stop is located at a predetermined position, and the protrusion is spaced from the fluid path when the stop is located at another position, along the axial direction thereof.

Further optionally, the valve structure may be configured to be opened when the stop is located at a first position where the stop is inserted intermediately in the opening, and closed when the stop is located at a second position where the stop is deeply inserted in the opening.

In one embodiment, a position where the fluid path communicates with the opening is located on an inner side surface of the opening. In this case, the communication between the fluid path and the opening is opened when the stop is located at the first position, and an outer side surface of the stop closes the communication between the fluid path and the opening when the stop is located at the second position.

Still optionally, the valve structure may include a protrusion that is protruded from a bottom surface of the stop at a position corresponding to the position where the opening communicates with the fluid path. The protrusion is fitted in the fluid path when the stop is fully or deeply inserted in the opening, the protrusion being spaced from the fluid path when the stop is located at an intermediate position along the axial direction thereof.

In some embodiments, the protrusion is located at a central portion of the bottom surface of the stop, and the fluid path communicates with the opening at a central portion of the bottom surface of the opening.

Preferably, the protrusion is formed to be slightly larger than a portion of the fluid path where the protrusion is fitted in, and the protrusion is compressed when fitted in the fluid path. Generally, when the protrusion is compressed, it is hardened. Thus, the above configuration improves the sealing effect.

In one embodiment, the protrusion has a conical shape. Alternatively, the protrusion may have a cylindrical shape. It may be possible to utilize various modifications of the shape of the protrusion.

In a particular case, the stop may include a barrel member and a closing wall defined inside the barrel member. The closing wall blocks a communication between both sides of the barrel member. In one embodiment, a thickness of the closing wall along the axis of the stop is smaller than a length of the barrel member along the axis of the stop. Of course, it is possible that the stop has a shape of solid cylinder.

Optionally, the protrusion is formed on an end of the barrel member. Corresponding to this configuration, a portion where the fluid path communicates with the opening is decentered and corresponding to a portion where the protrusion is formed on the end of the barrel member.

According to another aspect of the invention, there is provided an ink cartridge, which is provided with a housing defining a body of the cartridge, an ink reservoir accommodated in the housing, a first opening formed on the housing, the first opening communicating the ink reservoir through a first fluid path, a second opening formed on the housing, the second opening communicating the ink reservoir through a second fluid path.

The cartridge is further provided with a first stop to be fitted in the first opening, the first stop having elasticity, the first stop being configured such that a needle can be penetrated therethrough, a hole formed by penetration of the hollow needle being closed by the elasticity of the first stop after removal of the needle, a second stop to be fitted in the second opening, the second stop having elasticity, the second stop being configured such that a needle can be penetrated therethrough, a hole formed by penetration of the hollow needle being closed by the elasticity of the second stop after removal of the needle, a one-way valve provided between the first opening and the first fluid path, the one-way valve allowing a flow of fluid only in a direction from the ink reservoir to the first opening, the air inside the ink reservoir being evacuated through the first opening, a valve structure provided to a part of the second stop, the valve structure selectively opens and closes the communication between the second opening and the ink reservoir through the second fluid path.

Optionally, the ink cartridge may further include a connection member that connects end portions of the first stop and the second stop, the first stop the second stop and the connection member forming an integral stop.

Further, a groove may be formed between the first opening and the second opening. The groove is preferably configured such that the connection member is fitted in the groove. A surface of the housing where the first and second opening formed may be substantially planar when the first stop and the second stop are fully inserted in the first opening and the second opening, respectively, and the connection member is fitted in the groove.

Still optionally, the ink cartridge may include a protection film, which is adhered on the surface where the first opening and the second opening are formed to cover the first opening and the second opening with the first stop, the second stop and the connection member fitted in the first opening, the second opening and the groove, respectively.

Furthermore, opposing end portions of the protection film may be bent toward the housing to define bent portions, and the housing may be formed with grooves capable of receiving the bent portions. With this configuration, the bent portions can be accommodated in the grooves when the protection film is adhered on the surface where the first opening and the second opening are formed.

According to a further aspect of the invention, there is provided a method of filling an ink in an ink reservoir accommodated in an ink cartridge, the ink cartridge including a housing defining a body of the cartridge, an opening being formed on the housing, the opening communicating the ink reservoir through a fluid path, a stop to be fitted in the opening being provided, the stop having elasticity, the stop being configured such that a hollow needle can be penetrated therethrough, a hole formed by penetration of the hollow needle being closed by the elasticity of the stop after removal of the hollow needle, a valve structure being provided to a part of the stop, the valve structure selectively opens and closes the communication between the opening and the ink reservoir depending on a location of the stop. The method includes locating the stop at a position where the valve structure is opened, penetrating a hollow needle, supplying the ink to the ink reservoir through the hollow needle, removing the hollow needle from the stop, and locating the stop at a position where the valve structure is closed.

BRIEF DESCRIPTION OF THE ACCOMPANYING DRAWINGS

FIG. 1 is a side view schematically showing an entire structure of a complex machine to which the present invention is applicable;

FIG. 2 schematically shows a structure of an ink cartridge, printing head, a connecting structure therebetween and a purge mechanism;

DESCRIPTION OF THE EMBODIMENTS

Hereinafter, embodiments of the present invention will be described with reference to the accompanying drawings.

Figure 1:
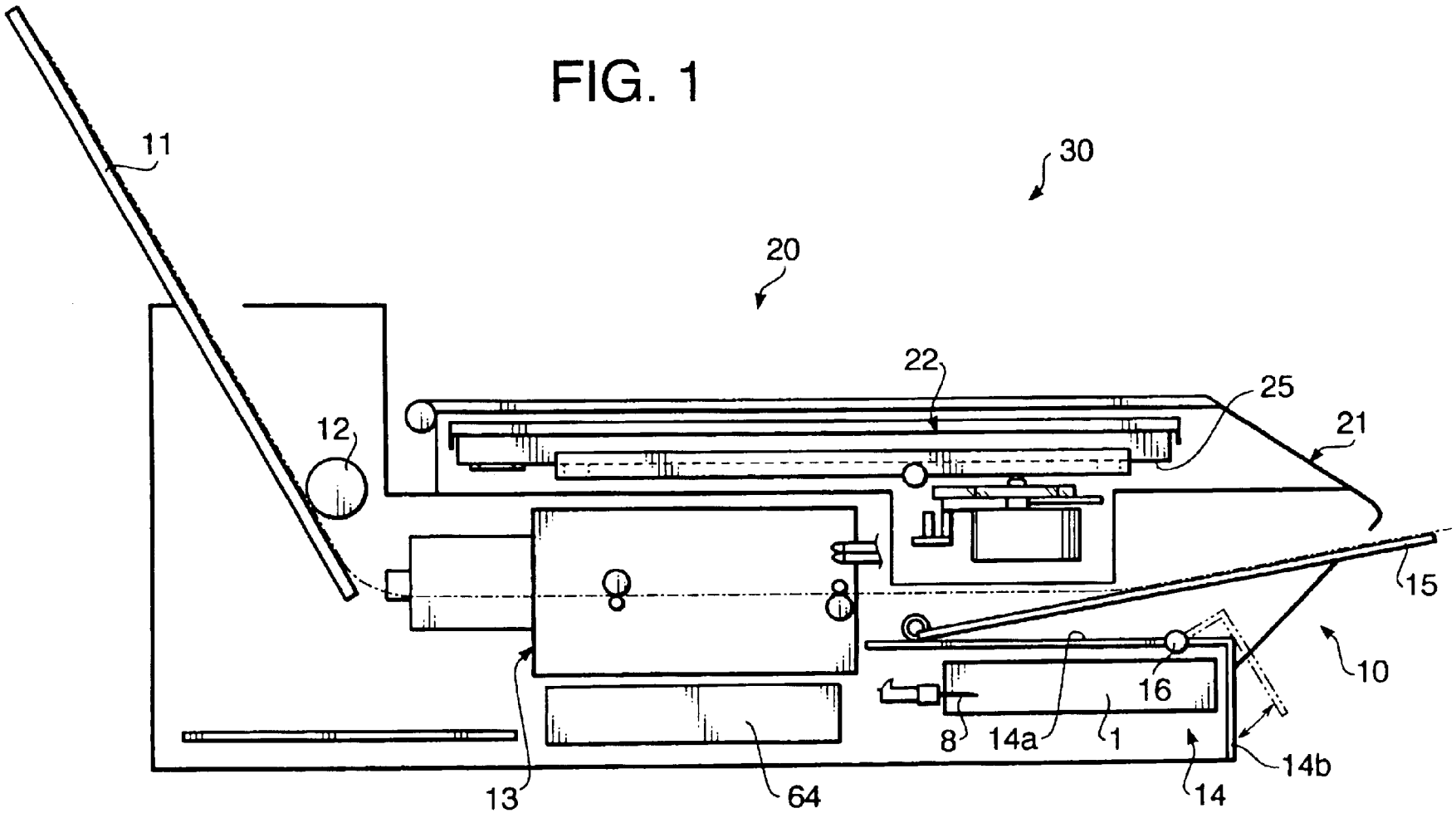

FIG. 1 shows an entire structure of a complex machine 30 employing an inkjet printer according to an embodiment of the invention.

Overall Structure of Complex Machine

The complex machine 30 shown in FIG. 1 is an inkjet printer having additional functions of an image scanner and a facsimile machine.

The complex machine 30 has a single body provided with a flat-bed type image scanner unit 20 and an inkjet printer unit 10 immediately below the image scanner unit 20.

The image scanner unit 20 has a flat bed reading unit 21 having a substantially rectangular solid shape, which is carried on an upper side surface of the complex machine 30. An original may be placed on a glass plate 22 of the flatbed reading unit 21, and is scanned using a close contact image to capture an image of the original.

The inkjet printer unit 10 has a sheet feed tray 11, which is arranged obliquely at a rear side (left-hand side in FIG. 1) of the complex machine 30. Recording sheets (e.g. a stack of paper) placed on the sheet feed tray 11 is fed one by one, by a pick up roller 12, from the tray 11 to a print engine 13 provided below the image scanner unit 20.

The print engine 13 is a well-known type of engine, including a platen roller, an inkjet head for jetting minute drops of inks (e.g., yellow, magenta, cyan and black inks) to the recording sheet, and the like.

The recording sheet is fed along a sheet feed path defined inside the print engine 13. As described above, the minute drops of color inks are jetted from the inkjet head onto the recording sheet fed along the sheet feed path, thereby a color image being formed on the recording sheet.

On a front side (right-hand side in FIG. 1) of the complex machine 30, a discharge tray 15 is provided. The sheet on which the image has been formed is discharged from the print engine 13 and stacked on the tray 15.

The inkjet printer unit 10 is formed of an ink cartridge insertion bay 14, which is located on the front side of the complex machine 30 and below the discharge tray 15.

Above the cartridge insertion bay 14, a first cover 14*a*, which is a plate member, is provided to cover the insertion bay 14. Further, a second cover 14*b* covering a front side of the insertion bay 14 is provided. The second cover 14*b* is rotatably supported by the first cover 14*a* through a hinge 16. With this structure, by rotating the second cover 14*b* upward (i.e., counterclockwise in FIG. 1), the insertion bay 14 is exposed to outside to allow an ink cartridge 1 to be inserted therein. In FIG. 1, the ink cartridge 1 has already been inserted in the insertion bay 14.

The insertion bay 14 is configured such that four ink cartridges respectively containing four colors of inks (i.e., yellow, magenta, cyan and black inks) are arranged in a direction perpendicular to a plane of FIG. 1 (only one cartridge is seen in FIG. 1).

In the ink cartridge bay 14, a hollow needle 8 is protruded toward the front side (right-hand side in FIG. 1) for each ink cartridge 1. When the ink cartridge 1 is inserted in the insertion bay 14, it becomes possible to supply the ink from an ink reservoir inside each ink cartridge 1 to the inkjet head through the hollow needle 8. The structure for supplying the ink will be described in detail later.

Figure 2:
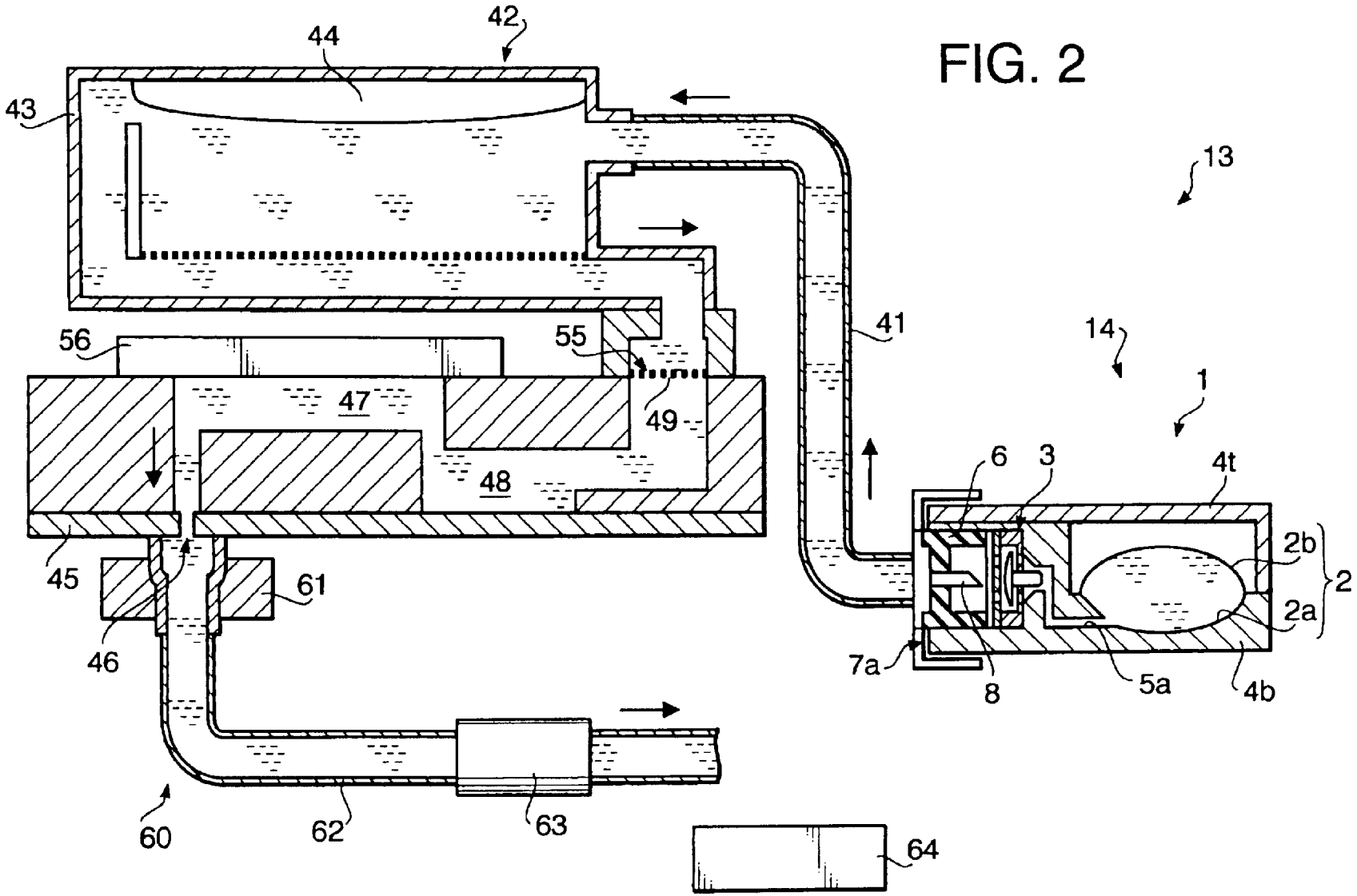

FIG. 2 schematically shows a structure for connecting the insertion unit 14 and the inkjet head, and a purge mechanism.

Each of the hollow needles 8 provided in the insertion bay 14 is connected to a recording head unit 42 through a tube 41 provided inside the complex machine 30. As described above, an ink reservoir 2 is formed inside the ink cartridge 1. The ink filled in the ink reservoir 2 is drawn through the hollow needle 8 is fed, through the tube 41, to an air trap 43 provided above the recording head unit 42. The air trap 43 traps the air by letting the bubbles suspend, with the floatation thereof, inside the air trap 43. The suspended air is indicated by reference numeral 44. Since the air trap 43 is located above an inkjet head 45, the air 44 suspended in the air trap 43 will not reach the inkjet head 45.

As described above, the recording head unit 42 has the inkjet head 45. The inkjet head 45 is provided with a plurality of nozzles 46 (only one is seen FIG. 1) for jetting the ink. In the inkjet head 45, a plurality of pressure chambers 47 are defined (only one is seen in FIG. 2), which communicate with the plurality of nozzles 46, respectively. The inkjet head 45 is further provided with a plurality of actuators 56 respectively for the plurality of pressure chambers 47. The actuators 56 include piezoelectric elements, respectively. By actuating each of the piezoelectric elements to change the capacity of corresponding pressure chamber 47, jetting energy is generated, which causes the ink to jet from the nozzle 46 as minute ink drops. The plurality of pressure chambers 47 communicate with a common ink chamber 48, to which the ink can be supplied from the air trap 43 through an ink inlet 49. At the ink inlet 49, a filter 55 is provided to prevent the impurities in the ink from entering the common ink chamber 48, and allows only the ink to pass through.

Adjacent to the inkjet head 45, a purge mechanism 60 is provided. The purge mechanism 60 includes a plurality of purge caps 61 for covering the plurality of nozzles 46 of the inkjet head 45, a plurality of purge pumps 63 for drawing the ink, a plurality of tubes 62 connecting the purge caps 61 and the inlets of the purge pumps 63, respectively, and a purged drain absorbing member 64. As shown in FIG. 1, the drain absorbing member 64 is located inside the complex machine 30, immediately below the print engine 13.

When a printing operation is performed, the purge caps 61 are spaced from the inkjet head 45. When a purging operation is performed, the purge caps 61 are closely contacted against the inkjet head 45 so as to cover the nozzles 46, respectively. With the condition shown in FIG. 2, by driving the purge pumps 63, a strong drawing flow is generated in the pressure chambers 47, common ink chamber 48, air traps 43 and tubes 41, and the bubbles and/or impurities in the ink are withdrawn out of the nozzles 46. The thus withdrawn ink including the bubbles and/or impurities is discharged from the tubes 62 to the drain absorbing member 64.

With the above-described purging operation, the bubbles and impurities in the fluid paths in the inkjet head 45 as well as in the tube 41 are removed. Accordingly, deterioration of the printing quality can be avoided.

Structure of Ink Cartridge

Next, an exemplary structure of an ink cartridge to be inserted in the insertion bay 14 will be described.

Figure 3:
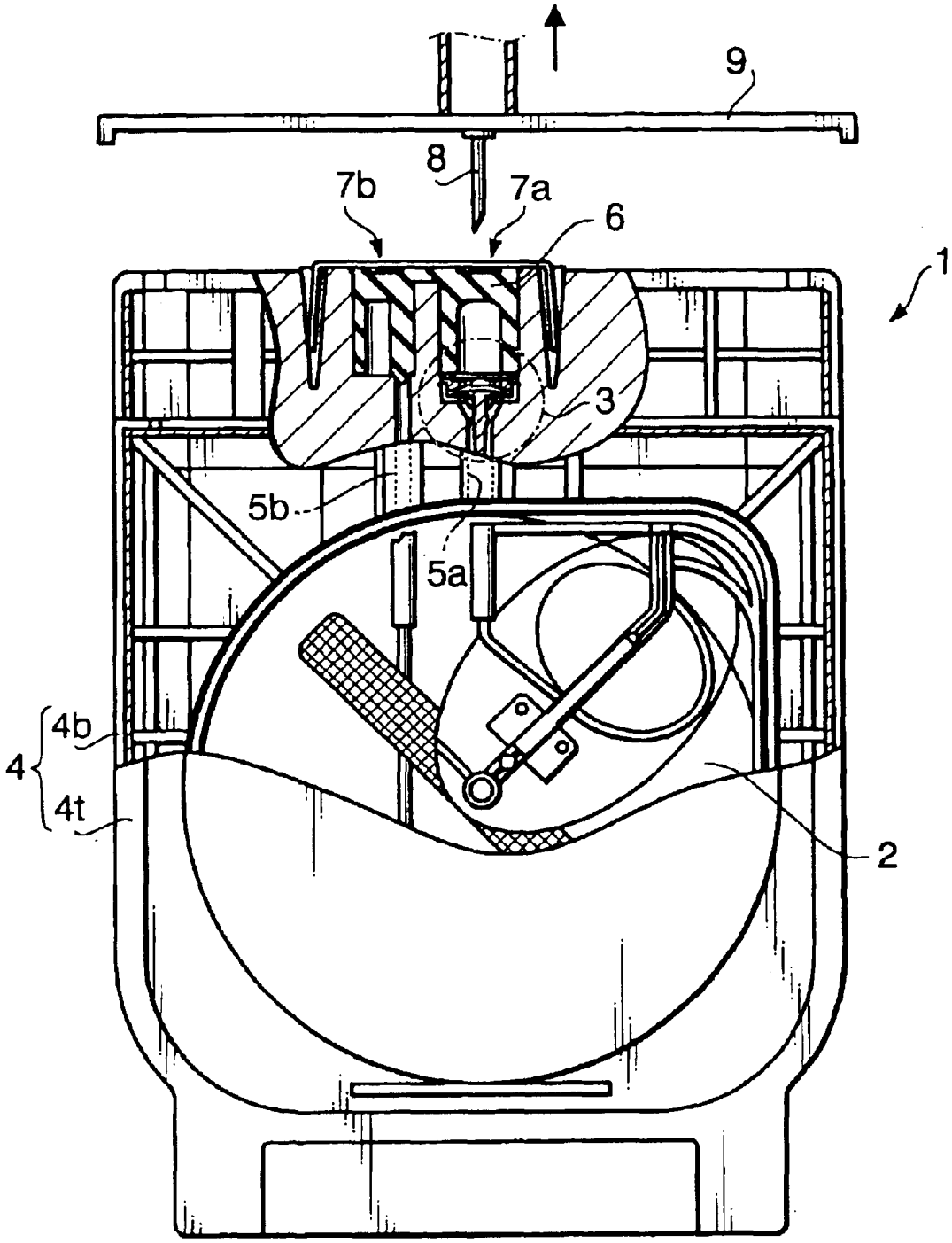
FIG. 3 is a partially sectioned plan view of the ink cartridge.
Figure 4A:
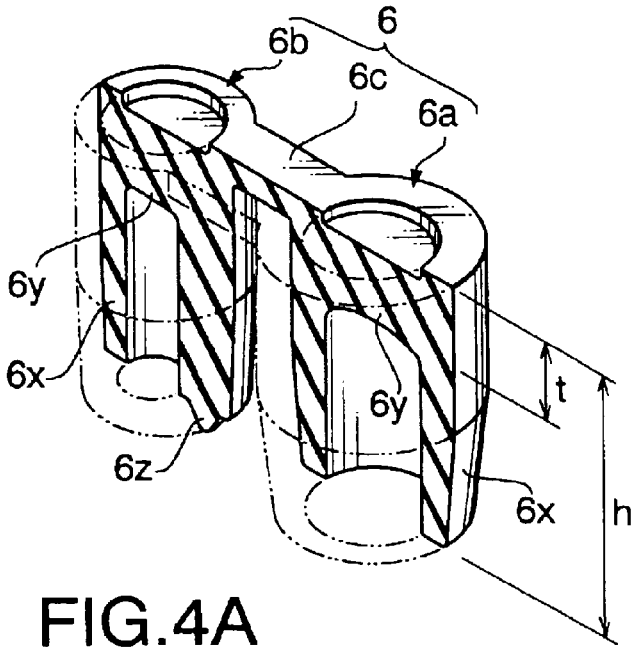
FIG. 4A is a partially sectioned perspective view of a rubber stop.
Figure 4B:
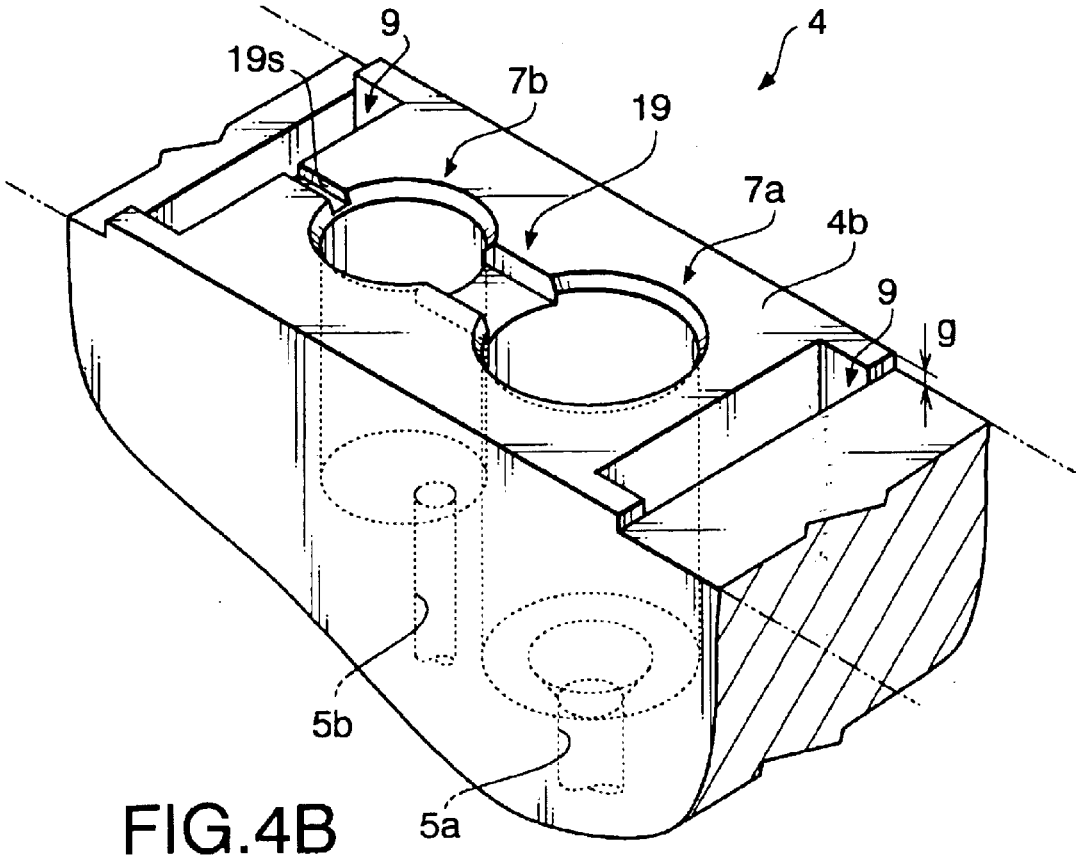
FIG. 4B is a perspective view showing a housing of the cartridge.
Figure 5:
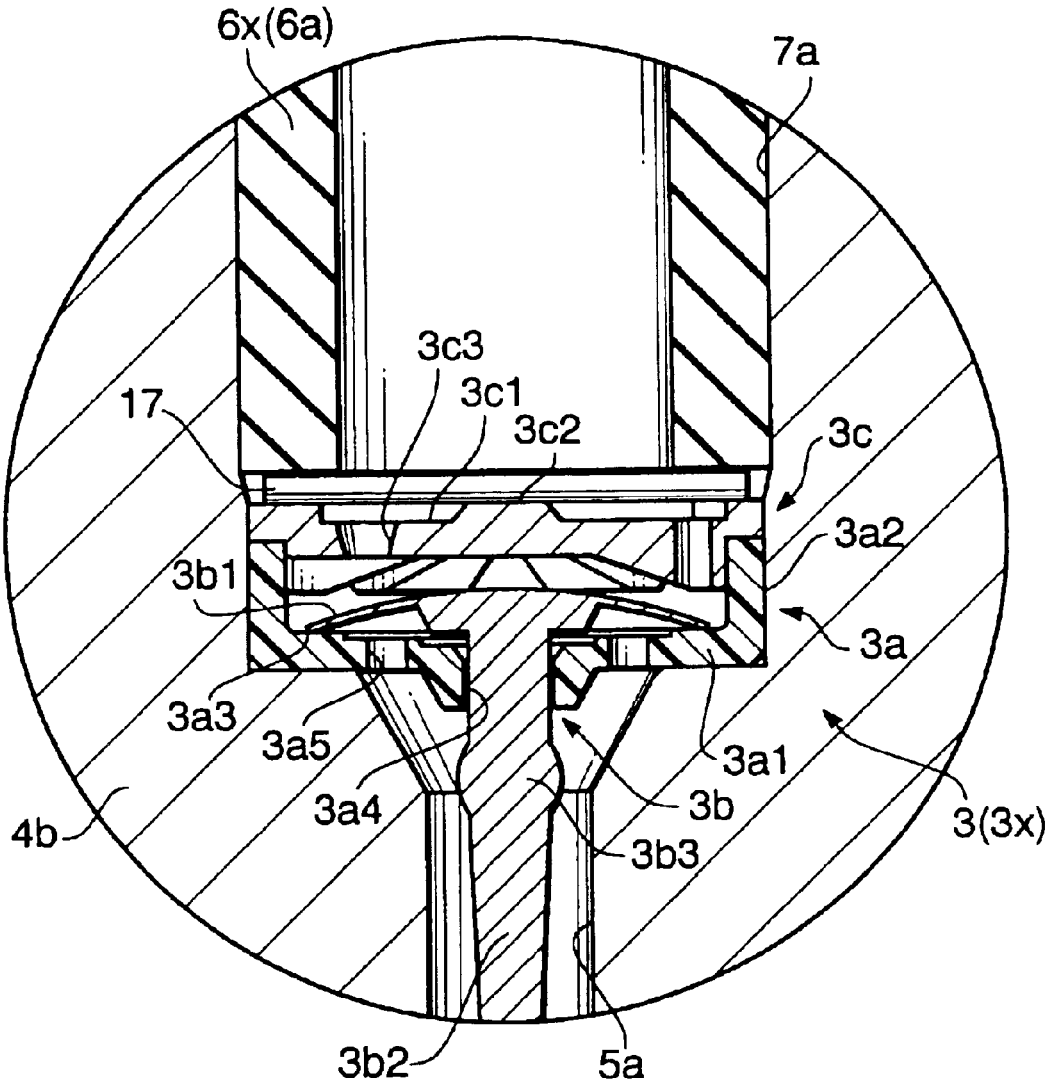
FIG. 5 shows a structure of a one-way valve, which is an enlarged view of a circled portion in FIG. 3.

FIG. 3 is a plan view, partly in cross section, of the ink cartridge 1. FIG. 4A is a perspective view, partly in cross section, of a rubber stop, and FIG. 4B is a perspective view showing a structure of a cartridge housing at a portion adjacent to two openings formed thereon. FIG. 5 shows a structure of a one-way valve formed on an opening, which is an enlarged view of a circled portion in FIG. 3.

As shown in FIG. 3, the ink cartridge 1 has a cartridge housing 4, which is configured to have an integrally formed upper unit 4*t* and lower unit 4*b*. It should be noted that, in FIG. 3, the up-and-down direction of the housing 4 is opposite to that of the figure. The cartridge housing 4 is formed of synthetic resin (e.g., polypropylene) including the ink reservoir 2 which can be filled with the ink, two openings 7*a* and 7*b* formed on an outer surface of the housing 4, and fluid paths 5*a* and 5*b* respectively connecting the openings 7*a* and 7*b* with the ink reservoir 2.

Ink Reservoir

As shown in FIG. 2, on an upper surface (i.e. an upper unit 4*t* side surface) of the lower unit 4*b* of the cartridge housing 4, a concave portion 2*a* is formed. Further, a flexible film 2*b* is provided to cover the entire concave portion 2*a*. Peripheral portions of the film 2*b* and the concave portion 2*a* are adhered with each other by supersonic or heat. The concave portion 2*a* and the film 2*b* form the ink reservoir 2.

Openings 7*a* and 7*b*

As shown in FIG. 3 and FIG. 4B, on the lower unit 4*b* of the cartridge housing 4, two cylindrical openings, a first opening 7*a* and a second opening 7*b*, are formed. The two openings 7*a* and 7*b* are arranged adjacently with respect to each other on a longitudinal side surface of the cartridge housing 4.

The first opening 7*a* is used for drawing the ink from the ink reservoir 2 and feeding the ink to the inkjet head 45, and the second opening 7*b* is used for filling the ink in the reservoir 2 when the ink cartridge 45 is manufactured. As shown in FIG. 4B, the first opening 7*a* is slightly larger than the second opening 7*b*.

Fluid Paths 5*a* and 5*b*

On the lower unit 4*b* of the cartridge housing 4, as shown in FIG. 3 and 4B, a first fluid path 5*a* and a second fluid path 5*b* for respectively connecting the openings 7*a* and 7*b* with the ink reservoir 2 are formed.

One end portion of the first path 5*a* is formed to be a skirt-like tapered shape, and connected to a central portion of an inner bottom surface of the first opening 7*a*, which has a circular shape. The first path 5*a* communicates with the first opening 7*a*. An end of the second path 5*b* is connected to an inner bottom surface of the second opening 7*b* at a position slightly decentered with respect to a central axis of the second opening 7*b*. The second path 5*b* communicates with the second opening 7*b*.

The other ends of the first and second paths 5*a* and 5*b* are exposed to the ink reservoir 2 (a bottom portion of the concave portion 2*a*) and communicate therewith.

Rubber Stop

In the openings 7*a* and 7*b*, a rubber stop 6 is to be fitted.

The rubber stop 6 is formed of elastic material such as silicon rubber. As shown in FIG. 4A, the rubber stop 6 has a first stop member 6*a* and a second stop member 6*b* respectively corresponding to the first opening 7*a* and the second opening 7*b*. The rubber stop 6 is an integrally formed member, which is configured such that the first and second stops 6*a* and 6*b* are connected by a connection member 6*c*. With this structure, the first and second stops 6*a* and 6*b*, which are relatively small members, can be handled as a single member, which improves handling of the same during manufacturing.

The top surfaces (i.e., the surface on a side opposite to the insertion direction) of the first and second stops 6*a* and 6*b*, and the outer surface of the connection member 6*c* are configured to be on the same plane.

On the surface of the housing 4 where the openings 7*a* and 7*b* are formed, a groove 19 having a predetermined depth is formed to connect the openings 7*a* and 7*b* to allow communication therebetween. The groove 19 is configured such that the connection member 6*c* is completely accommodated in the groove 19. Thus, when the first and second stops 6*a* and 6*b* are fully inserted in the first and second openings 7*a* and 7*b*, respectively, the top surfaces of the first and second stops 6*a* and 6*b*, the top surface of the connection member 6*c*, and the surface where the openings 7*a* and 7*b* are formed are on the same plane. In other words, unnecessary steps are not formed on the surface where the openings 7*a* and 7*b* are formed. Therefore, the appearance of the ink cartridge 1 is improved. Further, with this configuration, a protection film 18 can be attached easily, which will be described later. It should be noted that another groove 19*s* is also formed next to the second opening 7*b* (see FIG. 4B) on the surface where the first and second openings 7*a* and 7*b* are formed, which will be described in detail later.

Each of the first and second stops 6*a* and 6*b* has a barrel member 6*x* and closing wall 6*y*, which is formed inside the barrel member 6*x* to prevent communication between both sides along the axial direction of the barrel member 6*x*. The thickness t of the closing wall 6*y* in the axial direction is slightly smaller than the length h of the barrel member 6*x* in the axial direction (i.e., $t<h$). With this configuration, the hollow needle 8, an air suction needle 51 and ink filling needle 52 (which will be described later) can easily be penetrated through the stops 6*a* and 6*b*.

The outer diameters of the barrel members 6*x* of the first and second stops 6*a* and 6*b* are slightly greater than the inner diameter of the corresponding openings 7*a* or 7*b*, respectively. Thus, when the rubber stop 6 is fitted in the openings 7*a* and 7*b*, the barrel members 6*x* are compressed in the radial direction thereof. Therefore, the close contact between the outer surfaces of the barrel members 6*x* and the inner surfaces of the openings 7*a* and 7*b* is ensured, and with a sealing effect of the close contact, the ink is prevented from leaking outside. Further, due to the above configuration, in order to remove the rubber stop 6 from the openings 7*a* and 7*b*, relatively great force is required. Therefore, even if a force for pulling the rubber stop 6 is applied, the stop 6 will not removed easily.

Further to the above, the connection member 6*c* is configured to connect the first and second stops 6*a* and 6*b* at the outside the housing 4, and the thickness of the connection member 6*c* is thinner than the thickness of each of the first and second stops 6*a* and 6*b*.

It may be possible that the hollow needle 8 may be hooked by the connection member 6*c*, or a user may mistakenly remove the protection film 18 from the housing 4 and pull the connection member 6*c* with the finger. Even in such a case, with the above-described configuration, the stops 6*a* and 6*b* will not be removed easily since the connection member 6*c* may be cut before the stops 6*a* and 6*b* are removed from the openings 7*a* and 7*b* if such a strong force is applied. Thus, the removal of the stops 6*a* and 6*b* is effectively prevented, and the ink is prevented from leaking outside.

It should be noted that the outer surface of the barrel member 6*x* is formed such that an end portion on the opening 7*a* and 7*b* side is formed to be tapered (i.e., the outer diameter is gradually reduced on the end side). This shape eases an operation for fitting the barrel members 6*x* in the openings 7*a* and 7*b*.

The first stop 6*a* is formed such that the axis of the inner surface coincides with the axis of the outer surface. The second stop 6*b* is formed such that the axis of the inner surface is shifted with respect to the axis of the outer surface.

That is, the second stop 6*b* is configured such that the thickness in the radial direction is different depending on the circumferential portion thereof. Further, below the thicker portion of the barrel member 6*x* of the second stop 6*b*, a conical projection 6*z* is formed to protrude therefrom. The conical projection 6*z* is formed as a part of the second stop 6*b*, and located at a position corresponding to the second path 5*b*. When the rubber stop 6 is fitted in the openings 7*a* and 7*b*, the conical projection 6*z* closely contacts a portion where the second path 5*b* is connected to the bottom of the second opening 7*b* so as to seal the connected portion.

One-way Valve

The one-way valve 3 is provided at the bottom surface of the first opening 7*a*. The one-way valve 3 is provided to prevent the bubbles and impurities from invading in the ink reservoir 2. Specifically, the one-way valve 3 allows the ink to proceed from the ink reservoir 2 to the first opening 7*a* (i.e., the first stop 6*a*), and prevents the ink from proceeding from the first opening 7*a* (i.e., the first stop 6*a*) to the ink reservoir 2.

FIG. 5 shows an enlarged view of the circled portion in FIG. 3, and shows a structure of the one-way valve 3. The one-way valve 3 includes a vale supporting member 3*a*, a valve body 3*b*, a cover member 3*c*, which are integrally assembled (a one-way valve assembly 3*x*). The one-way valve assembly 3*x* is arranged at a position between the first opening 7*a* and the first path 5*a*.

Hereinafter, the three members consisting the one-way valve assembly 3*x* will be further described.

The valve supporting member 3*a* is formed of synthetic resin. The valve supporting member 3*a* includes a circular bottom plate 3*a*1, and a cylindrical side wall 3*a*2 rising perpendicularly at the peripheral end of the bottom plate 3*a*1. Accordingly, as shown in FIG. 3, the valve supporting member 3*a* has a U-shaped cross section. On the upper surface of the bottom plate 3*a*1 (i.e., on the inner surface of the supporting member 3*a*), a valve seat 3*a*3 is formed as a planar member. At the central portion of the valve seat 3*a*3, a supporting hole 3*a*4 is formed. Further, a plurality of flowing holes 3*a*5 are formed around the supporting hole 3*a*4.

The valve body 3*b* is a main part of the one-way valve 3, and is formed of silicon rubber. The valve body 3*b* is an umbrella-shaped member consisting of an umbrella portion 3*b*1 and a handle portion 3*b*2. The handle portion 3*b*2 is inserted through the supporting hole 3*a*4, thereby the valve body 3*b* is displaceable in a direction of the axis of the supporting hole 3*a*4. As a result, the axial movement and elastic deformation of the umbrella portion 3*b*1, it is possible to bring the valve body 3*b* in one of the following two status:

(a) A closing status: the umbrella portion 3*b*1 closely contacts the valve seat 3*a*3 of the valve supporting member 3*a* and close the flowing holes 3*a*5; and (b) An opening status: the umbrella portion 3*b*1 is spaced from the valve seat 3*a*3 so that the flowing holes 3*a*5 are opened.

The cover 3*c* is engaged with the side wall 3*a*2 of the valve supporting member 3*a* such that it covers one side portion (a portion opposite to the valve seat 3*a*3) of the umbrella portion 3*b*1 of the valve body 3*b*. The cover 3*c* is formed with a communication hole 3*c*1, which allows the ink flowing, via the first path 5*a*, from the ink reservoir 2 to proceed toward the outside of the housing 4.

In order to have a stroke of deformation of the valve body 3*b*, a predetermined clearance is provided between the inner surface of the covet 3*c* and the valve seat 3*a*3.

On the central portion of the outer surface of the cover 3*c*, a reception surface 3*c*2, which contacts a filter 17 (described later) is formed. An annular groove 3*c*3 to face the filter 17 is formed around the reception surface 3*c*2, and the annular groove 3*c*3 is connected with the communication hole 3*c*1.

Manufacturing Process of Ink Cartridge

A manufacturing process of the ink cartridge 1 will be described, revolving around the assembling procedure of parts around the openings 7*a* and 7*b*.

Figures 6A, 6B, 6C:
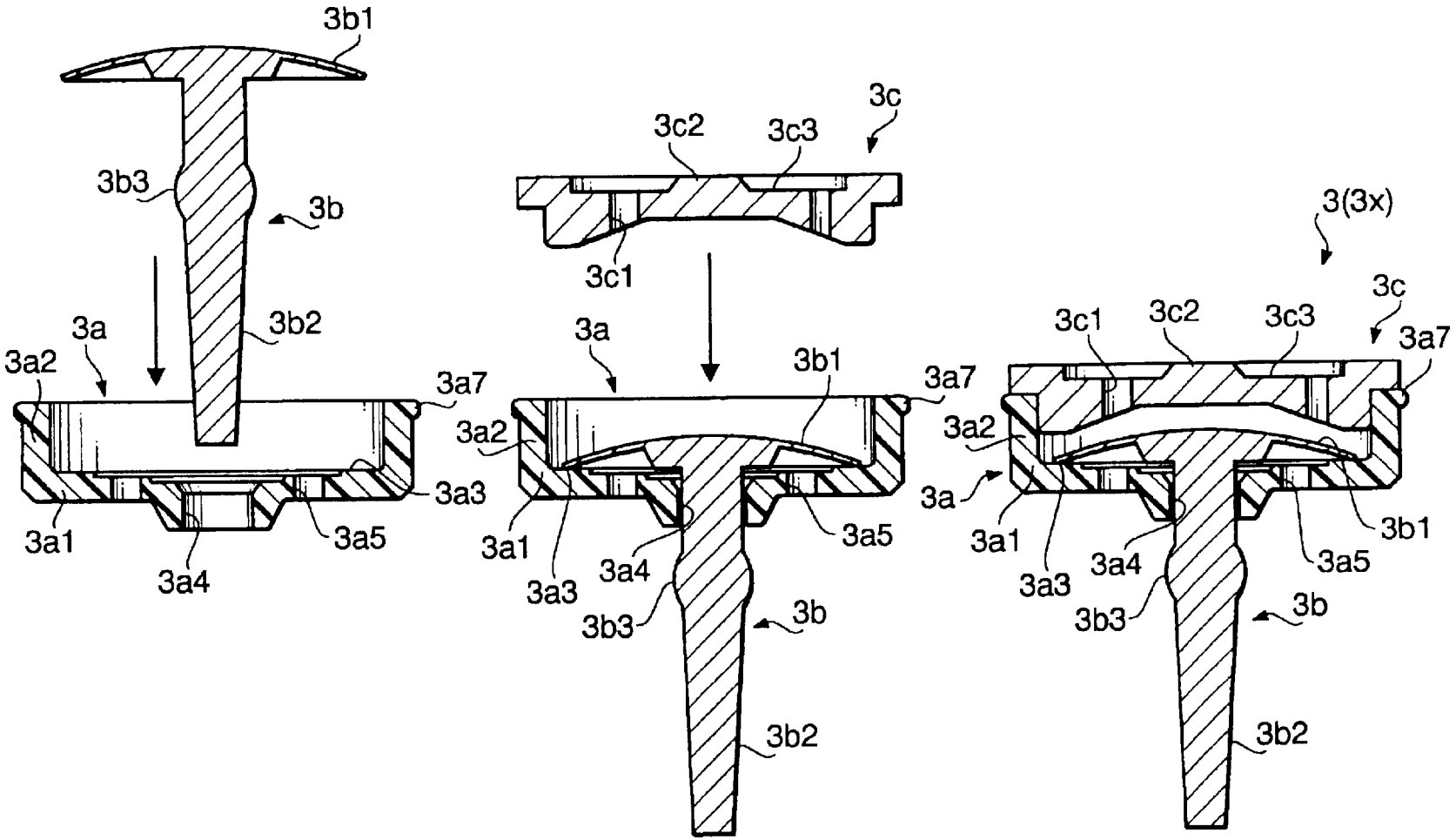
FIGS. 6A–6C show procedures of manufacturing the one-way valve shown in FIG. 5.
Figure 7:
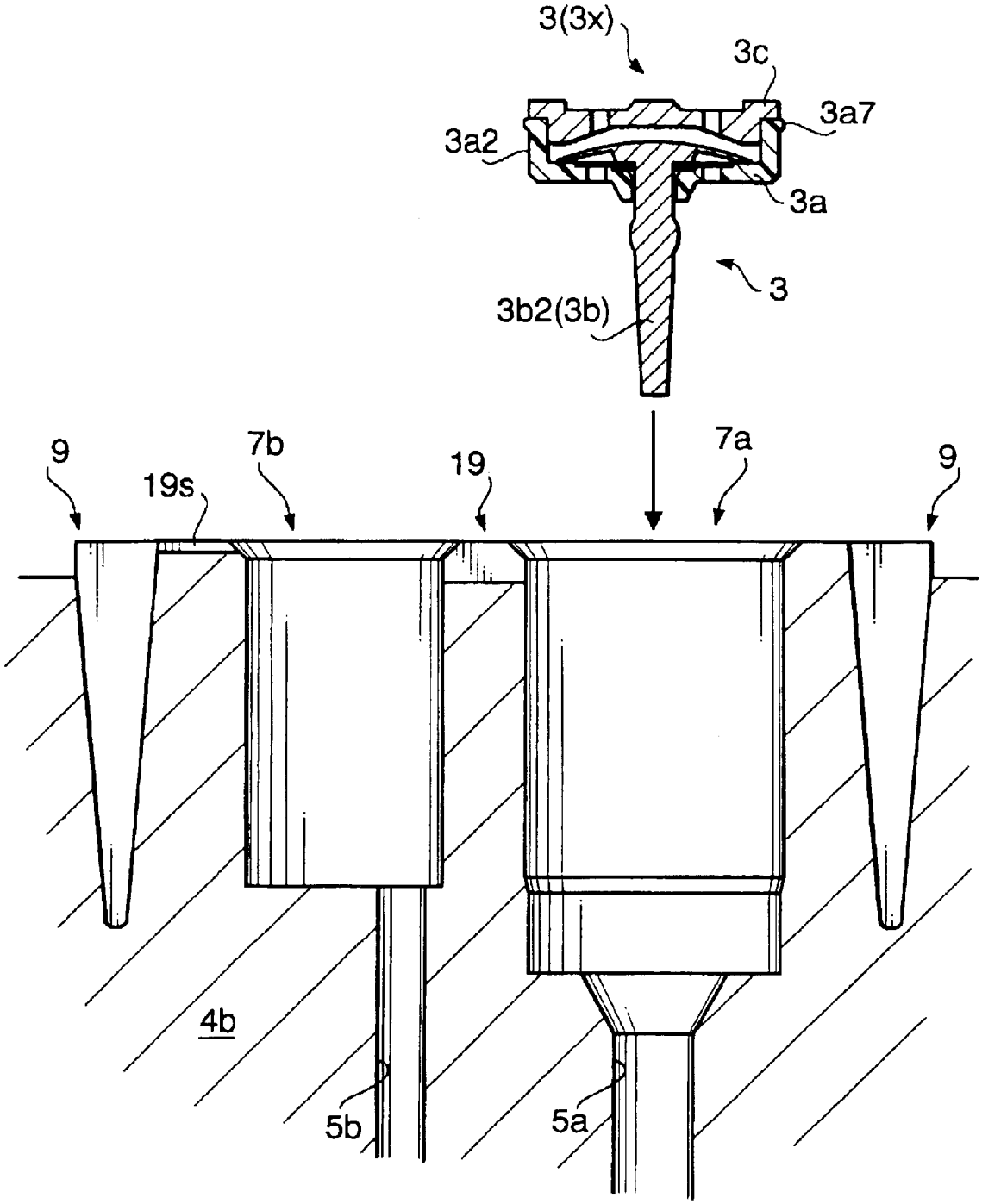
FIG. 7 shows a procedure for attaching the one-way valve to a first opening of the housing.
Figure 8:
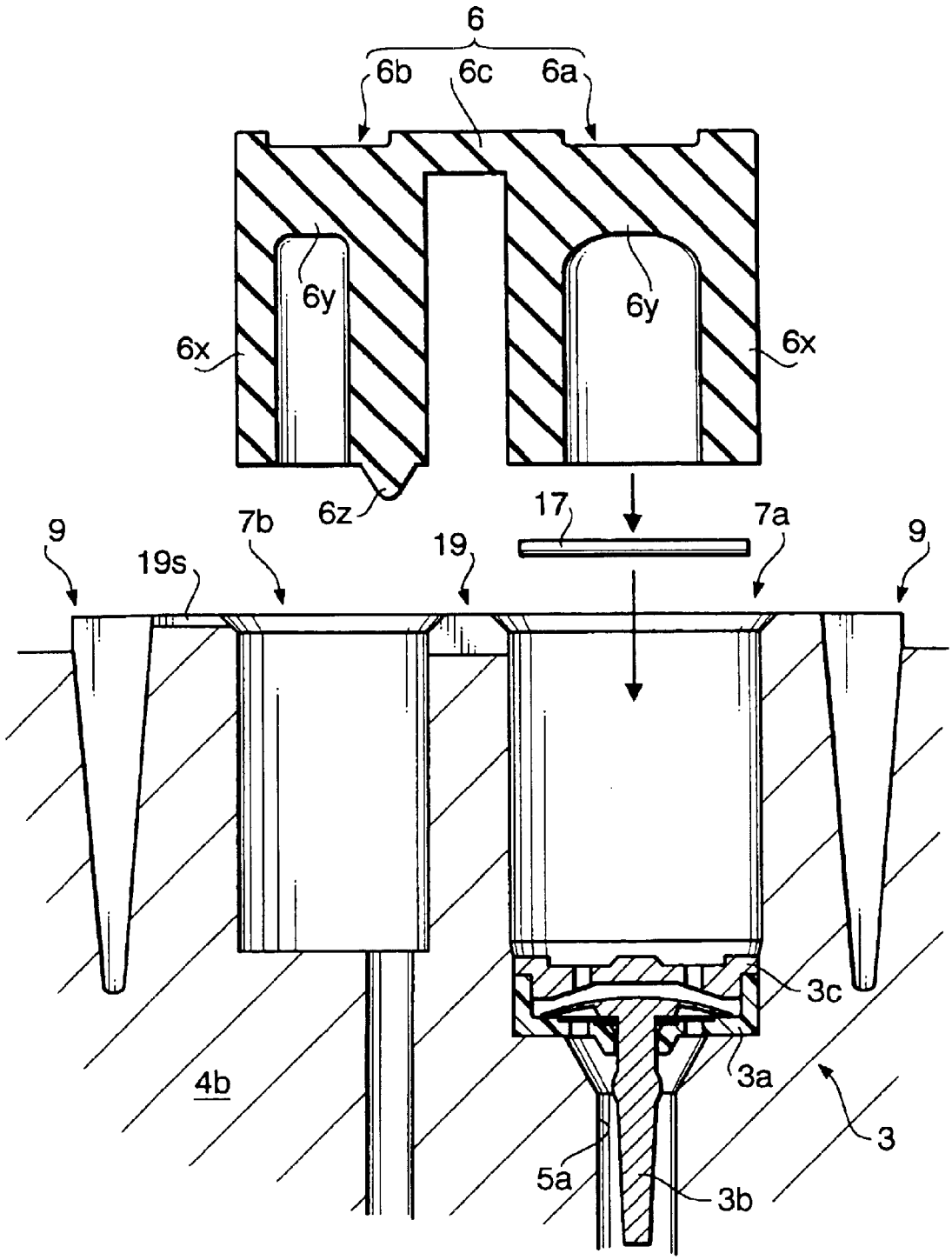
FIG. 8 shows a procedure for assembling a filter and the rubber stop to the housing.
Figure 9:
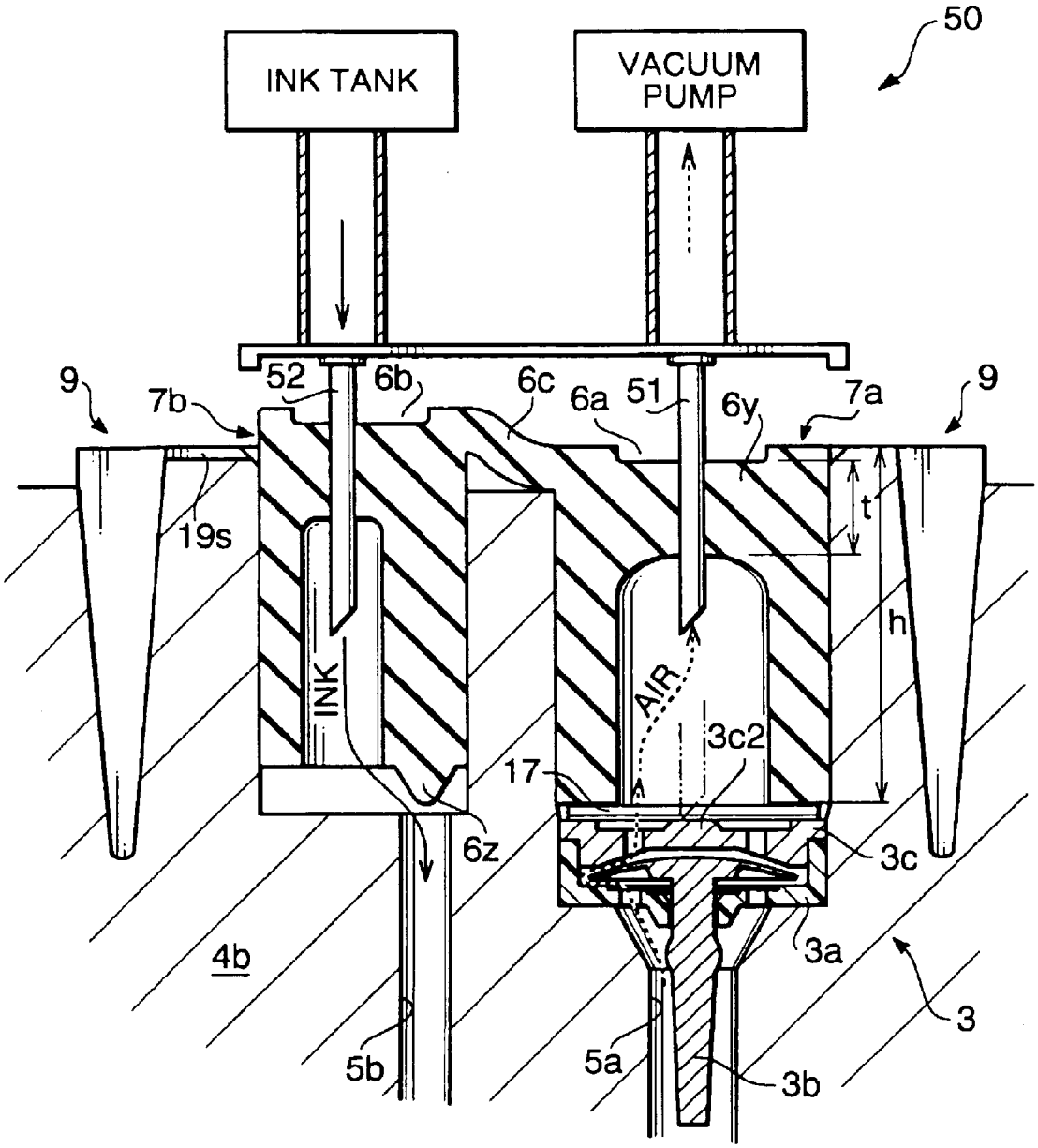
FIG. 9 shows a procedure for filling the ink.
Figure 10:
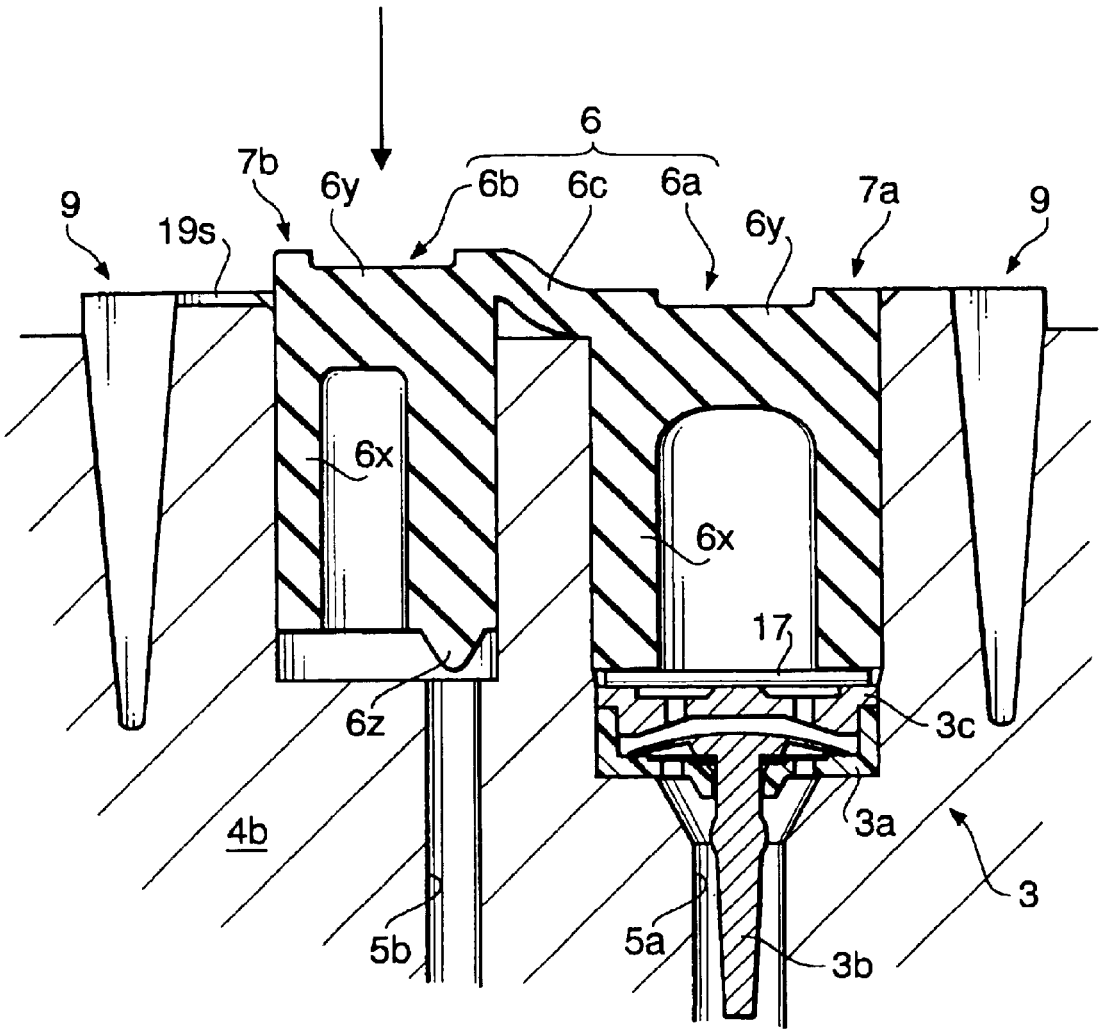
FIG. 10 shows a second stop inserted in a second opening.
Figure 11:
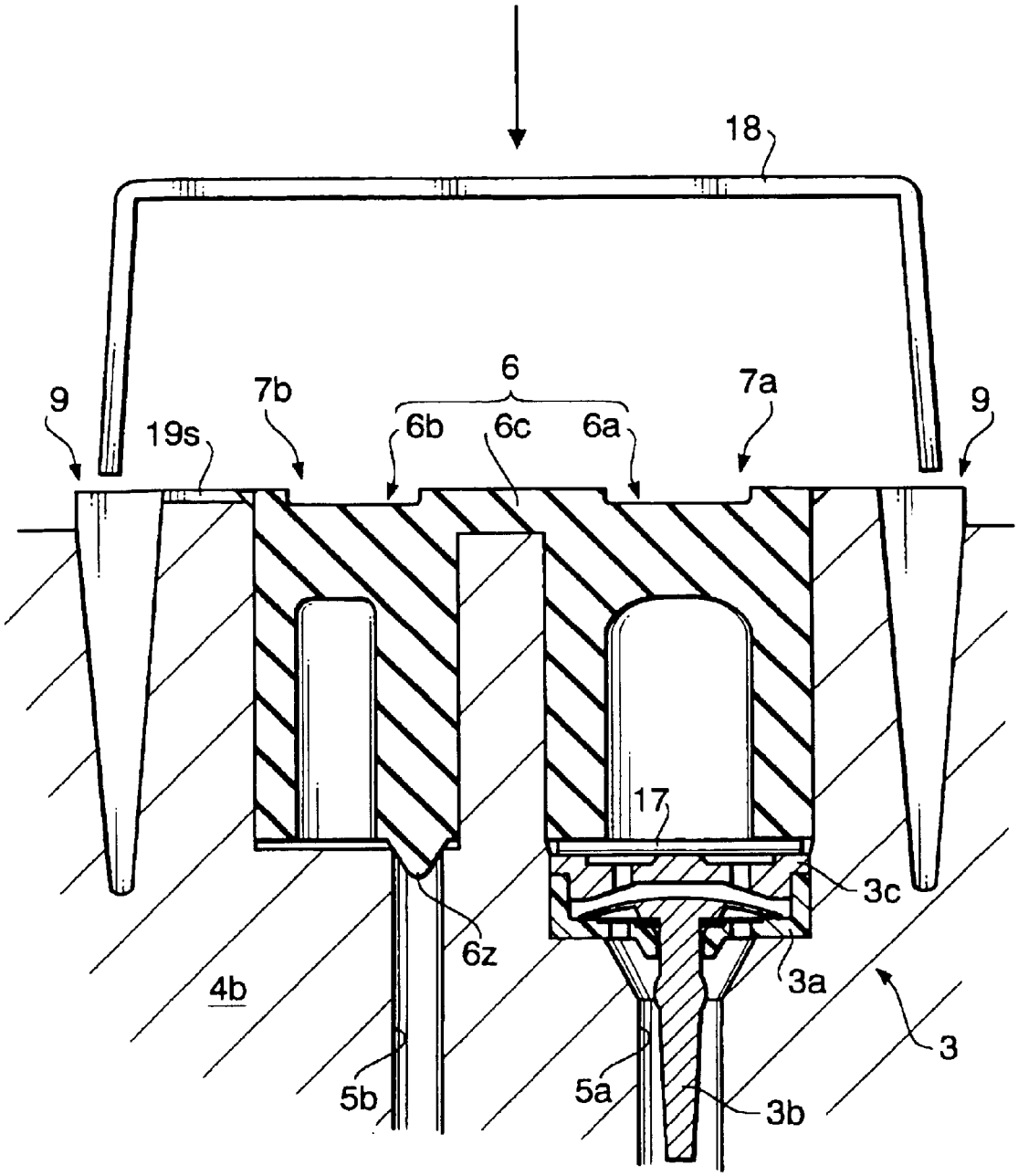
FIG. 11 shows a protection film attached to the housing.
Figure 12:
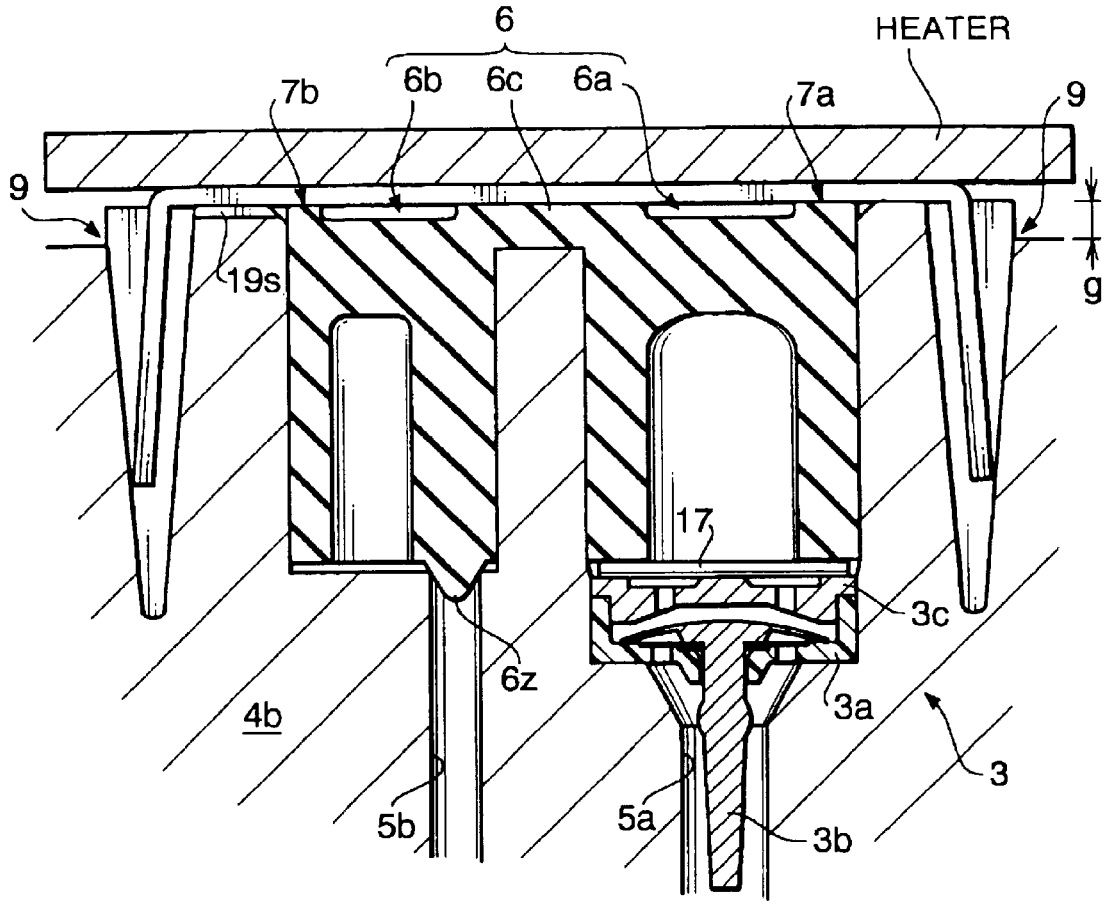
FIG. 12 shows a procedure for heat-staking the protection film onto the housing.

FIGS. 6A–6C show a process for assembling the one-way valve, and FIG. 7 shows a process for attaching the one-way valve to the first opening. FIG. 8 shows a process for assembling the filter and rubber stop, and FIG. 9 shows a process for filling the ink. FIG. 10 shows a process for inserting the second stop 6*b* completely in the second opening 7*b* to seal the second path 5*b*. Further, FIG. 11 shows a process for attaching the protection film to the cartridge housing, and FIG. 12 shows a process for heat staking the protection film on the cartridge housing.

The ink cartridge 1 according to the embodiment, the one-way valve 3 is firstly assembled to form the one-way valve assembly 3*x*. Then, the one-way valve assembly 3*x* is coupled to the cartridge housing 4. Therefore, the assembling process of the one-way valve assembly 3*x* will be described firstly, with reference to FIGS. 6A–6C.

In FIG. 6A, the handle portion 3*b*2 of the valve body 3*b* is Inserted in the supporting hole 3*a*4 formed on the valve supporting member 3*a*, and the umbrella portion 3*b*1 is located inside the valve supporting member 3*a*.

The handle portion 3*b*2 is formed with a larger diameter portion 3*b*3 at an intermediate portion thereof. The larger diameter portion 3*b*3 has a diameter slightly greater than that of the supporting hole 3*a*4. Since the valve body 3*b* is formed of silicon rubber, the larger diameter portion 3*b*3 can be compressed in the radial direction, and thus the larger diameter portion 3*b*3 can be passed through the supporting hole 3*a*4, and the umbrella portion 3*b*1 can be located inside the valve supporting member 3*a* as shown in FIG. 6B. Once the larger diameter portion 3*b*3 passes through the supporting hole 3*a*4, it functions to restrict the removal of the valve body 3*b* from the supporting hole 3*a*4. Therefore, the valve body 3*b* and the valve supporting member 3*a* can be handled unitarily, which eases the assembling process.

Next, the cover 3*c* is fitted in the valve supporting member 3*a* as shown in FIGS. 6B and 6C. Thus, the assembling process of the one-way valve assembly 3*x* is completed (FIG. 6C). As can be seen in FIG. 6C, the valve body 3*b* is movable with respect to the valve seat 3*a*3 in the up-and-down direction in FIG. 6C. Thus, the one-way valve assembly 3*x* functions as the one-way valve.

It should be noted that, since the one-way valve assembly 3*x* is assembled firstly, and then it is attached to the ink cartridge 1. Therefore, it becomes possible to examine whether the one-way valve assembly 3*x* functions correctly before it is attached to the ink cartridge. This process improves yielding ratio in the manufacturing procedure.

Items for examining the one-way valve assembly 3*x* may include whether the valve body 3*b* moves smoothly with respect to the valve supporting member 3*a* without being hooked, whether there is not leakage between the valve body 3*b* and the valve seat 3*a*3 when the valve body 3*b* is in the closing status, and the like.

After the one-way valve assembly 3*x* is assembled, it is attached to the first opening 7*a* of the cartridge housing as shown in FIG. 7.

In this process, the one-way valve assembly 3*x* is oriented such that the tip of the handle portion 3*b*2 of the valve body 3*b* is straightly directed to the bottom of the opening 7*a*, and push-inserted therein from the handle portion 3*b*2. It should be noted that the first opening 7*a* is formed to be slightly tapered such that the bottom portion has a smaller diameter in order to ease the insertion of the one-way valve assembly 3*x*. Finally, the one-way valve assembly 3*x* is inserted in the opening 7*a* such that the valve supporting member 3*a* contacts the bottom surface of the first opening 7*a*, as shown in FIG. 8. In this status, the umbrella portion 3*b*2 of the valve body 3*b* is located inside the first path 5*a*.

It should be noted that the first opening 7*a* is formed such that the inner diameter at the bottom portion is smaller as shown in FIG. 7. Further, the side wall 3*a*2 of the valve supporting member 3*a* has a flange portion 3*a*7 whose diameter is slightly greater than the inner diameter of the bottom portion of the first opening 7*a*. Therefore, the one-way valve assembly 3*x* is push-inserted in the first opening 7*a*, with plastic deformation of the flange portion 3*a*7 and/or the inner surface of the bottom portion of the first opening 7*a*.

In this process, if the one-way valve assembly 3*x* is appropriately oriented and the umbrella portion 3*b*2 is inserted in the first opening 7*a*, the one-way valve assembly 3*x* will not incline to be oriented in an appropriate direction. Thus, once the one-way valve assembly 3*x* is inserted in the first opening 7*a*, only by pushing the one-way valve assembly 3*x* using a stick or the like, without using a particular jig, the one-way valve assembly 3*x* can be appropriately coupled to the housing 4.

The improvement of the productivity described above is particularly significant when the first opening 7*a* is a relatively narrow and deep opening and/or the valve body 3*b* is a relatively small, hard-to-handle member.

After the one-way valve assembly 3*x* (i.e., the one-way valve 3) has been fixed in the first opening 7*a*, a filter 17 is inserted in the first opening 7*a* as shown in FIG. 8. The filter 17 is to contact the cover 3*c* of the one-way valve assembly 3*x*. The filter 17 is for eliminating the impurities included in the ink fed from the ink reservoir 2 to the inkjet head 45.

Then, as shown in FIG. 8, the first and second stops 6*a* and 6*b* of the rubber stop 6 are fitted in the first and second opening 7*a* and 7*b*, respectively. It should be noted that the first stop 6*a* is completely inserted in the first opening 7*a*, while the second stop 6*b* is not completely inserted in the second opening 7*b* but slightly spaced from the bottom surface of the opening 7*b*, as shown in FIG. 9. That is, at this stag the second stop 6*b* is located at a position where the outer surface of the barrel member 6*x* closely contacts the inner surface of the second opening 7*b*, and the protrusion 6*z* is spaced from the second path 5*b*. As will be described below, at this stage, the second path 5*b* should communicate with the second opening 7*b* in order to allow the ink to flow from the second opening 7*b* to the ink reservoir 2.

After the rubber stop 6 is coupled as described above, an ink is filled to the ink cartridge 1. The ink filling operation is performed using a dedicated ink filling apparatus 50, which is provided with the air suction needle 51 to be inserted in the first opening 7*a*, the ink filling needle 52 to be inserted in the second opening 7*b*. The air suction needle 51 and the ink filling needle 52 are arranged next to each other so as to correspond to the arrangement of the first and second openings 7*a* and 7*b*.

The air suction needle 51 is connected with a vacuum pump and the ink filling needle 52 is connected with an ink tank for filling the ink.

FIG. 9 schematically shows a condition where the ink cartridge 1 is coupled to the ink filling apparatus 50. It should be noted that the shape, orientation and arrangement of various parts including those of the needle 51 and 52, openings 7*a* and 7*b*, stops 6*a* and 6*b* are determined such that, as shown in FIG. 9, the air suction needle 51 penetrates the closing wall 6*y* of the first stop 6*a*, and the ink filling needle 52 penetrates the closing wall 6*y* of the second stop 6*b*.

As aforementioned, since the thickness t of the closing walls 6*y* is greater than the thickness h of the barrel portion 6*x* in the axial direction, when the needle 51 or 52 is penetrated through the closing walls 6*y* or withdraw therefrom, relatively low resistance is generated. Therefore, the operation for coupling the ink cartridge 1 with the ink filling apparatus 50 or detaching the ink cartridge 1 therefrom is relatively easy. In particular, when the coupling operation, the two needles 51 and 52 will not be applied with unnecessary force that may bend or break the same.

The closing walls 6*y* are located such that when the ink cartridge 1 is coupled to the ink filling apparatus 50, the needles 51 and 52 penetrate the closing walls 6*y*, respectively. The barrel members 6*x* extend, with respect to the closing walls 6*y*, toward the bottom surfaces of the first and second openings 7*a* and 7*b*, respectively.

Therefore, by adjusting the length of the needles 51 and 52 such that it is shorter than the length of the barrel members 6*x* but sufficiently long to penetrate through the closing walls 6*y*, it is possible to locate the tip of the needles 51 and 52 at positions facing the bottom surfaces of the first and second openings 7*a* and 7*b*, respectively.

As described above, the ink can be filled in the ink reservoir 2 without fail, even through the needles 51 and 52 are relatively short. Therefore, the manufacturing cost of the ink filling apparatus 50 can be reduced.

The shorter needles 51 and 52 are advantageous in that the needles 51 and 52 may not be bent or broken when the ink cartridge 1 is coupled to the ink filling apparatus 50. It should be noted that the outer diameter of the needles 51 and 52 are required to have as thin as possible. If the needle are too thick, the resistant force generated when the needle penetrates through the rubber stop 6 is relatively large, and further, a penetration hole through which the need was penetrated may not completely closed with the elasticity of the rubber stop 6. Further, the needles should be formed as hollow needles. Therefore, the strength of the needles is limited, and the needles are easy to bend. According to the configuration described above, the length of the needles can be reduced. Therefore, even the needles are relatively thin, they are hardly bent or broken when the ink cartridge 1 is coupled to or removed from the ink filling apparatus 50.

If the vacuum pump is actuated under the condition shown in FIG. 9, the air resides in the ink reservoir 2 proceeds through the first path 5*a*, the one-way valve 3 that is automatically opened by the negative pressure, toward the first opening 7*a*. The air finally sucked through the suction needle 51 and evacuated away.

When the ink reservoir 2 is depressurized as described above, the ink is supplied from the ink tank, through the ink filling needle 52, the second path 5*b*, to the ink reservoirs 2. The ink is filled until the film 2 bulges as shown in FIG. 2, with measuring the filled amount.

With the above process, no air resides in the ink reservoir 2, the paths 5*a* and 5*b*, the openings 7*a* and 7*b*, which are filled with the ink. After the ink filling operation is completed, the cartridge 1 is detached from the ink filling apparatus 50, the needles 51 and 52 being pulled out from the rubber stop 6.

Since the rubber stop 6 is formed of silicon rubber, the holes which are formed by penetrating the two needles 51 and 52 are closed due to the elasticity of the silicon rubber. Thus, it is not necessary to perform a replacement procedure or sealing procedure after the ink filling operation. Thus, in accordance with the above described configuration, the number of manufacturing processes can be reduced.

It should be noted that, in the above described manufacturing procedure, the air suction needle 51 and the ink filling needle 52 are penetrated to the rubber stop at the same time, and the suction of the air and the filling of the ink are performed substantially simultaneously. However, it is only an exemplary procedure, and the invention is not limited to the same.

For example, the air suction needle 51 may be penetrated first to evacuate the air, and thereafter, the ink filling needle 52 is penetrated to fill the ink.

Specifically, the air suction needle 51 is penetrated through the first stop 6*a*, and the vacuum pump is actuated to evacuate the air so as to depressurize the ink reservoir 2 almost to the vacuum level. Then, the air suction needle 51 is removed from the first stop 6*a*, and the ink filling needle 52 is penetrated through the second stop 6*b*. Due to the negative pressure inside the ink reservoir 2, the ink is supplied to the ink reservoir through the ink filling needle 52.

As aforementioned, the hole formed on the first stop 6*a* by the air suction needle 51 is closed by the elasticity of the first stop 6*a*, the air will not flow inside through the first opening 7*a*. Even if the air enters through the first opening 7*a*, the one-way valve 3 functions to prevent the air from flowing toward the ink reservoir 2.

When the air suction needle 51 is penetrated, by some reason, it may be inserted excessively so that the tip of the needle 51 may be located at a position indicated by two-dotted line in FIG. 9. However, according to the above-described configuration, the cover 3*c* is provided on the first stop 6*a* side of the one-way valve 3, and the air suction needle 51 is prevented from proceeding further. That is, the cover 3*c* preventing, the air suction needle 51 from proceeding, and therefore, the air suction needle 51 will not reach the one-way valve 3. Thus, the one-way valve 3 will not be broken, and the yielding ratio is raised.

As aforementioned, the reception surface 3*c*2 is formed on the cover 3*c* at the central portion (at a portion to which the excessively inserted needle 51 may reach) thereof. The filter 17 is provided to contact the reception surface 3*c*2. Therefore, even if the air suction needle 51 is excessively inserted, as the tip of the needle 51 is blocked by the reception surface 3*c*2, only the sharp portion of the needle 51 penetrates through the filter 17, and the thick portion of the needle 51 does not penetrate through the filter 17. Therefore, a relatively large hole will not be formed on the filter 17, and the filter 17 functions correctly even after penetrated by the needle 51.

As shown in FIG. 10, after the ink is filled, the second stop 6*b* of the rubber stop 6 is fully inserted in the second opening 7*b*, thereby the opening at which the second path 5*b* communicates with the bottom surface of the second opening 7*b* is sealed by the protrusion 6*z*.

That is, the second stop 6*b* can be movable along the axis of the second opening 7*b* to locate at an opening position, at which the protrusion 6*z* is spaced from the second path 5*b*, and a closing position, at which the protrusion 6*z* close contacts the end of the second path 5*b* to seal the path. The protrusion 6*z* allows the ink to flow from the second stop 6*b* to the ink reservoir 2 when the ink filling operation is performed, while the protrusion 6*z* prevents the flow of the ink after the ink filling operation has been completed.

In other words, when the second stop 6*b* is completely fitted in the second opening 7*b*, a first sealing effect caused by the close contact between the outer surface of the barrel member 6*x* and the Inner surface of the second opening 7*b*, and a second sealing effect caused by the close contact of the protrusion 6*z* and the end of the second path 5*b* are available. Therefore, by the first and second sealing effects, it is ensured that invasion of the air from the second opening 7*b* to the ink reservoir 2 through the second path 5*b* is prevented, and leakage of the ink supplied from the ink reservoir through the second path 5*b* and the second opening 7*b* is prevented.

After the second stop 6*b* is fully inserted in the second opening 7*b*, the protection film 18, which is formed of a thin plate member having end portions which are bent so that the protection film 18 has a U-shaped cross section, is secured onto the cartridge housing 4 such that it covers the openings 7*a* and 7*b* in which the rubber stop 6 is fitted, as shown in FIG. 11. Although the cross-sectional structure will not be illustrated, it has integrally formed (stacked) two layers: a layer formed of polypropylene (which is the same as the material of the housing 4); and a layer formed of polyethylene terephthalate which has higher heat resistance properties than the polypropylene.

The film 18 is attached to the housing 4 with the layer of the polypropylene facing the openings 7*a* and 7*b*. Then, as shown in FIG. 12, a heater is applied from the outside so that the layer of the polypropylene is fused, thereby the protection film 18 being adhered on the ink cartridge 4.

With this configuration, removal of the rubber stop 6 from the openings 7*a* and 7*b* when handling the cartridge 4 is prevented.

As described above, since the inner surface of the protection film 18 is formed of polypropylene, when the heater is applied as shown in FIG. 12, it fused and well bonded onto the housing 4 which is also formed of polypropylene.

On the cartridge 4, a pair of narrow grooves 9 and 9 are formed with the two openings 7*a* and 7*b* located therebetween. When the protection film 18 is bonded on the cartridge 4, the bent end portions of the protection film 18 are inserted in the grooves 9 and 9, respectively. Since the end portions of the protection film 18 are located inside the cartridge housing 4 (i.e., since the end portions of the protection film 18 are not exposed to outside), even if an external force is applied, the protection film 18 will not be peeled from the end portions thereof.

As shown in FIG. 4B and FIG. 12, the surface of the cartridge 4 on which the openings 7*a* and 7*b* are formed is configured such that a portion where the protection film 18 is bonded is protruded with respect to the other portions by a predetermined amount g. Further, the portion where the protection film 18 is bonded is formed to be a planar surface except for the portion where the rubber stop 6 is attached.

Accordingly, when the heater having a planar heat applying surface is placed on the protection film 18, only the portion where the protection film 18 is bonded can be heated, which ensures the adhesion. Further, since the other portion is spaced from the heat applying surface of the heater by the amount g, the surface of the housing 4 will not be fused unnecessarily. Thus, the appearance will not be deteriorated by the unnecessarily fused portion of the housing 4.

Further, as shown in FIGS. 4B and 12, the groove 19*s* is formed next to the second opening 7*b*. The groove 19*s* communicates with the second opening 7*b* at one end, and with one of the grooves 9 at the other end. When the ink cartridge 1 has been assembled, it will be vacuum-packaged so as to be stored for a long time. When the ink cartridge is enclosed in a vacuum packaging, the pressure inside the ink cartridge 1 may become higher than the pressure outside the ink cartridge due to the air retained inside the ink cartridge. If the protection film 18 completely seals the upper surface of the housing 4, since there is a minute gap or passage through which the air flows between the rubber stop 6 and the openings 7*a* and 7*b*, due to the difference of the pressures, the protection film 18 may become easy to be unstuck. According to the embodiment, by providing the groove 19*s*, the inner space of the ink cartridge 1 and the groove 9 communicate with each other. Therefore, the pressure difference between the inside and outside of the ink cartridge 1 is dissolved. Therefore, the adhesiveness of the protection film 18 with respect to the surface of the housing 4 is improved.

It should be noted that, in the embodiments, only one groove 19*s* is provided next to the second opening 7*b*. However, it is only an exemplary configuration, and the groove 19*s* may be formed next to the first opening 7*a*, or two grooves 9 may be formed respectively next to the first and second openings 7*a* and 7*b*. Further, the location of the groove 19*s* is not limited to the above-described location. As long as it allows communication between the inside of the ink cartridge and the outside thereof, a groove (or an opening) having any shape at any location provides the same effect.

It should be noted that, for bonding the protection film 18, a fusing device utilizing supersonic wave can be used instead of the heater described above.

Connection Between Cartridge and Complex Machine

A coupling condition of the ink cartridge 1 to the complex machine 30 will be described with reference to FIGS. 2 and 13.

Figure 13:
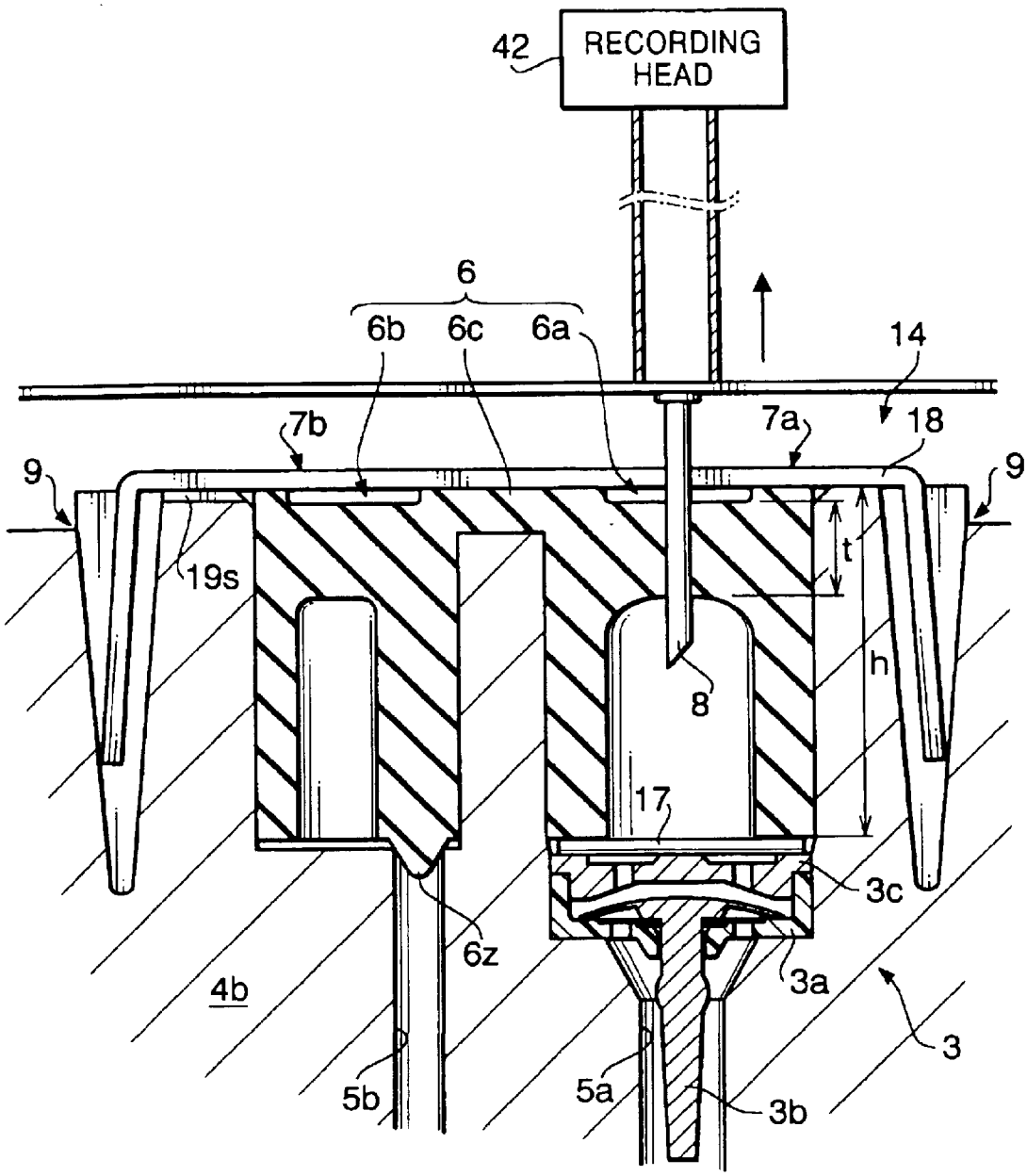
FIG. 13 shows a condition where the ink cartridge is coupled to a cartridge bay.

FIG. 13 shows a condition where the ink cartridge 1 is coupled to the cartridge bay of the complex machine 30.

As shown in FIG. 13, the hollow needle 8 provided at the cartridge bay 14 is penetrated through the protection film 18 and the first stop 6*a* when the ink cartridge 1 is coupled to the cartridge bay 14. The tip of the hollow needle 8 is located at a position between the filter 17 and the inner surface of the closing wall 6*y* of the first stop 6*a*.

Under this condition, the ink in the reservoir 2 is supplied, through the path 5*a*, the one-way valve 3, the hollow needle 8, the tube 41 (see FIG. 2), to the head unit 42.

It should be noted that, positions and arrangement of the hollow needle 8 is determined so that, when the cartridge housing 4 is coupled to the cartridge bay 14 of the complex machine 30, the hollow needle 8 for drawing the ink from the ink reservoir 2 penetrates through the closing wall 6*y* and is located at the above-described position.

As described above, the thickness t of the closing wall 6*y* is smaller than the thickness h of the barrel member 6*x* along the axial direction. Therefore, similarly to the case of the two needles 51 and 52 of the ink filling apparatus 50, the resistance force is relatively small when the hollow needle 8 is penetrated through and pulled out of the closing wall 6*y*. Accordingly, the operation for coupling the ink cartridge 1 to the cartridge bay 14 is relatively easy, and unnecessary force for bending and/or breaking the hollow needle 8 may not be applied to the hollow needle during the coupling operation.

Further, the rubber stop 6 is formed of silicon rubber. Therefore, when the hollow needle 8 is penetrated through the closing wall 6*y*, and then removed, a hole formed by the penetrated needle 8 will be closed by the elasticity of the silicon rubber. Therefore, even if the cartridge 1 once coupled is removed, the ink remaining therein will not leak since the hole formed by the hollow needle 8 is closed when the cartridge 1 is removed from the cartridge bay 14.

Furthermore, similarly to the case of the ink filling apparatus 50, the closing wall 6*y* is located at a position where the hollow needle 8 penetrates through the closing wall 6*y* when the cartridge 1 is inserted In the cartridge bay 14. The barrel member 6*x* of the first stop 6*a* extends on the bottom surface side of the first opening with respect to the closing wall 6*y*.

Therefore, if the length of the hollow needle 8 is determined such that it only penetrates the closing wall 6*y* of the first stop 6*a*, even though it is shorter than the length of the barrel member 6*x* along the axial direction, the tip of the hollow needle 8 faces the bottom of the first opening 7*a* (i.e., located within a space between the bottom of the opening. 7*a* and the inner surface of the closing wall 6*y*), and the ink in the ink reservoir 2 can be supplied to the recording head unit through the hollow needle 8.

As described above, even though the length of the hollow needle 8 is suppressed, the ink can be supplied to the recording head unit 42 appropriately. Accordingly, the manufacturing cost of the cartridge bay 14 can be reduced.

The above-described configuration is also advantageous in that the hollow needle 8 is hardly bent. Similar to the needles 51 and 52 of the ink filling apparatus 50, the hollow needle 8 is required to be relatively thin, and have a hollow structure. Therefore, the hollow needle 8 is easily bent when an external force is applied. According to the above-described configuration, however, since the length of the hollow needle 8 can be suppressed, the hollow needle 8 may not be bent easily even if it is relatively thin.

The second path 5*b* communicates with the second opening 7*b* at a position which is decentered with respect to the central axis of the second opening 7*b*. Therefore, even if the hollow needle 8 is penetrated through the closing wall 6*y* of the second stop 6*b*, i.e., the tip end of the hollow needle 8 is located in the second opening 7*b*, by erroneous operation of some other reason, unless the hollow needle 8 is further inserted to penetrate through the thick portion of the barrel member 6*x* of the second stop 6*b* and the protrusion 6*z*, the tip of the hollow needle 8 will not reach the second path 5*b*.

Accordingly, even if an erroneous operation is performed as described above, the air or impurities will not enter the ink reservoir from outside through the hollow needle 8.

As described above, the second stop 6*b* and the protrusion 6*z* function as a valve mechanism. That is, when the first stop 6*b* is positioned such that the protrusion 6*z* is spaced from the second path 5*b*, the "valve" is opened. When the first stop 6*b* is moved to be positioned such that the protrusion 6*z*close the end of the second path 5*b*, the "valve" is closed. In other words, the "valve" is selectively opened or closed depending on the axial position of the second stop 6*b*.

An exemplary embodiment has been described with reference to the accompanying drawings. The invention is not limited to the above embodiments, and various modification will be considered without departing from the gist of the invention. For example, the protrusion 6*z* for closing the second path 5*b* may have various modifications. Some examples of the modification of the protrusion 6*z* will be described hereafter as second through fourth embodiments of the invention.

Second Embodiment

FIGS. 14A through 14D show a structure of the openings 7*a* and 7*b*, and the stops 6*a* and 6*b*, according to a second embodiment.

Figure 14A:
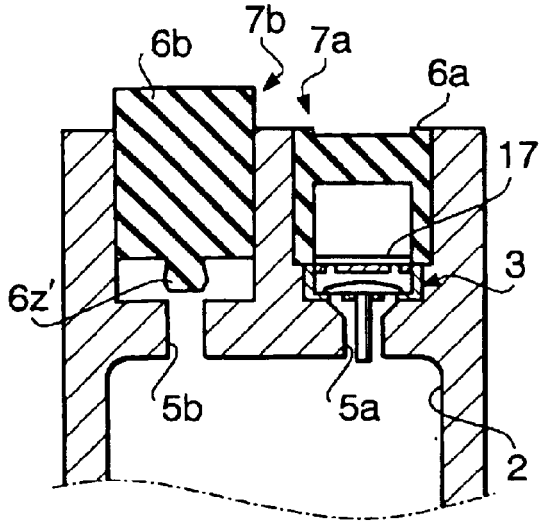
FIGS. 14A–14D show a structure of openings formed on the housing and a rubber stop fitted therein according to a second embodiment.

According to the second embodiment, as shown in FIG. 14A, the second stop 6*b* is provided with a protrusion 6*z*' having a substantially cylindrical shape, which is different from the conical shape of the protrusion 6*z* shown in FIG. 8. Further, the protrusion 6*z*' is provided at the central portion of the bottom surface of the second stop 6*b*. Corresponding to the location of the protrusion 6*z*', the second path 5*b* communicates with the second opening 7*b* at the central portion of the bottom surface of the opening 7*b*.

Figure 14B:
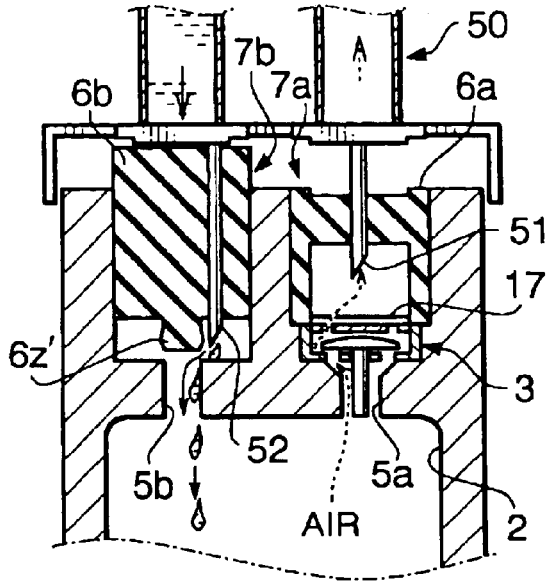

FIG. 14B shows an ink filling operation according to the second embodiment. Similarly to the first embodiment, when the ink filling operation is performed, the second stop 6*b* is not completely inserted In the second opening 7*b*, and the protrusion 6*z*' is spaced from the second path 5*b* so that the second path 5*b* communicates with the second opening 7*b*. Therefore, the ink can be supplied from the second opening 7*b* to the ink reservoir 2 through the second path 5*b*.

As shown in FIG. 14B, the air suction needle 51 is penetrated through the closing wall 6*y* of the first stop 6*a*, and the ink filling needle 52 is penetrated through the second stop 6*b* such that the tip end of the ink filling needle 52 is protruded from the bottom surface of the second stop 6*b* at a position where the protrusion 6*z*' is not provided. The ink filling operation is similar to that performed in the first embodiment.

Figure 14C:
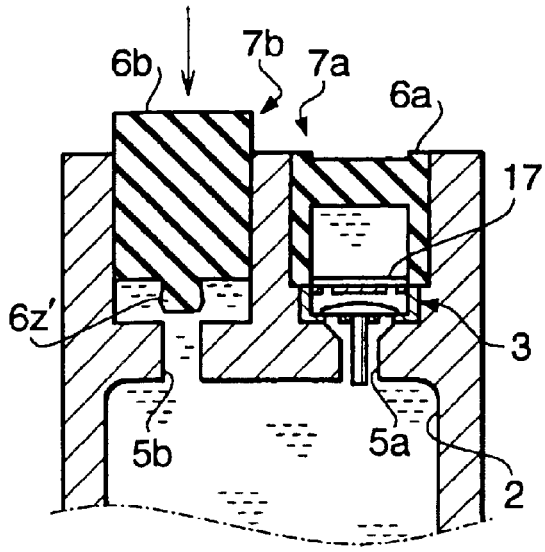
Figure 14D:
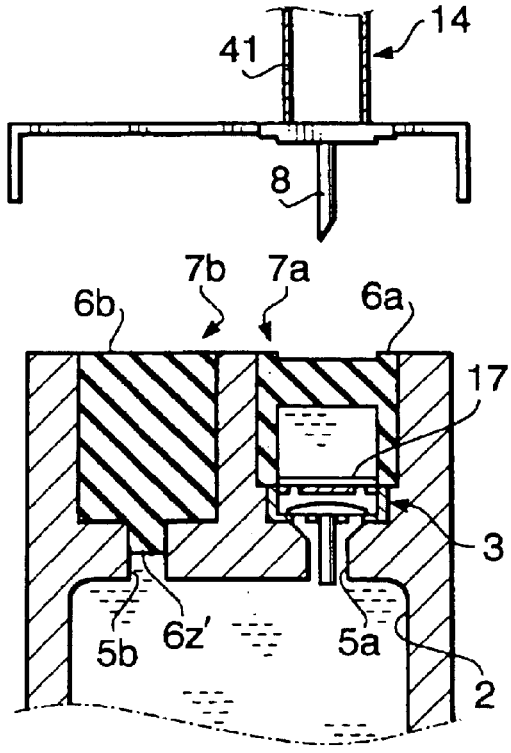

After the ink is filled, the second stop 6*b* is fully inserted in the second opening 7*b* as shown in FIGS. 14C and 14D so that the protrusion 6*z*' is inserted in the second path 5*b*. It should be noted that the protrusion 6*z*' is formed to have a larger diameter than the inner diameter of the second path 5*b*. Therefore, when the second stop 6*b* is press-inserted in the second opening, the protrusion 6*z*' is inserted in the second path 5*b* with being compressed and deformed. With this configuration, after the protrusion 6*z*' is inserted in the second path 5*b*, the outer surface of the protrusion 6*z*' closely contacts the inner surface of the second path 5*b*, thereby the second path 5*b* being completely closed and does not communicate with the second opening 7*b* as shown in FIG. 14D.

As a result, the flow of the ink from the second stop 6*b* side to the ink reservoir 2 is prevented, and therefore, invasion of bubbles and impurities in the ink reservoir 2 is avoidable. Further, under the condition shown in FIG. 14D, if a user erroneously attempts to penetrate a needle through the second stop 6*b*, it is very difficult to have the needle penetrate through the protrusion 6*z*' since it is compressed and therefore hardened. Therefore, the invasion of the bubbles and impurities due to such an erroneous operation is also avoidable.

Third Embodiment

Figure 15A:
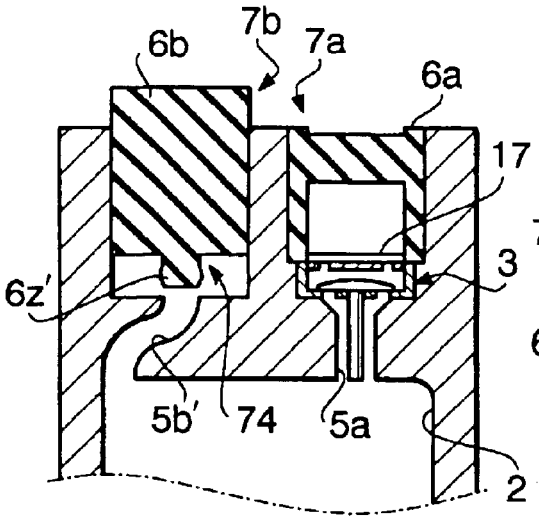
FIGS. 15A–15D show a structure of openings formed on the housing and a rubber stop fitted therein according to a third embodiment.

FIGS. 15A through 15D show a structure of the openings 7*a* and 7*b*, and the stops 6*a* and 6*b*, according to a second embodiment. The third embodiment is similar to the second embodiment except that an incision is formed on the protrusion 6*z*' at its proximal end (i.e., the second stop 6*b* side end), and a curved second path 5*b*' is provided instead of the straight second path 5*b*, as shown in FIG. 15A.

Figure 15B:
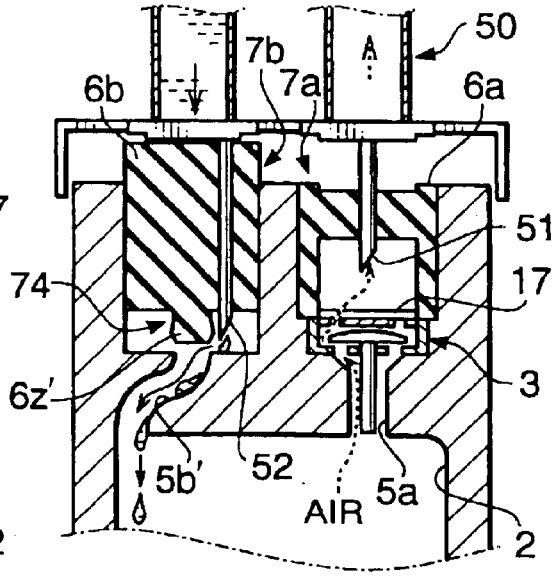

FIG. 15B shows an ink filling operation according to the third embodiment. Similarly to the first embodiment, when the ink filling operation is performed, the second stop 6*b* is not completely inserted in the second opening 7*b*, and the protrusion 6*z*' is spaced from the second path 5*b*' so that the second path 5*b*' communicates with the second opening 7*b*. Therefore, the ink can be supplied from the second opening 7*b* to the ink reservoir 2 through the second path 5*b*'.

Figure 15C:
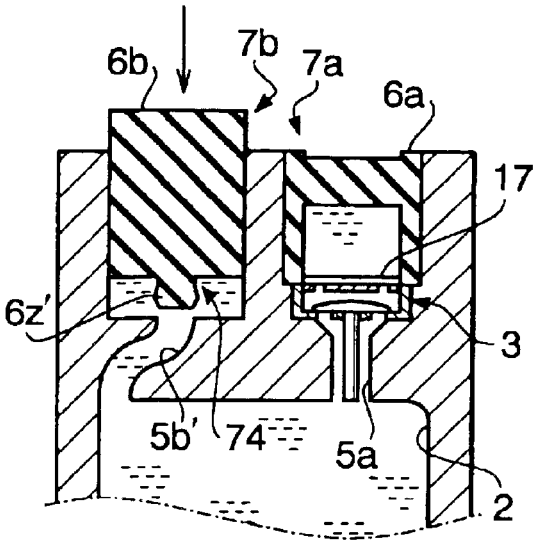
Figure 15D:
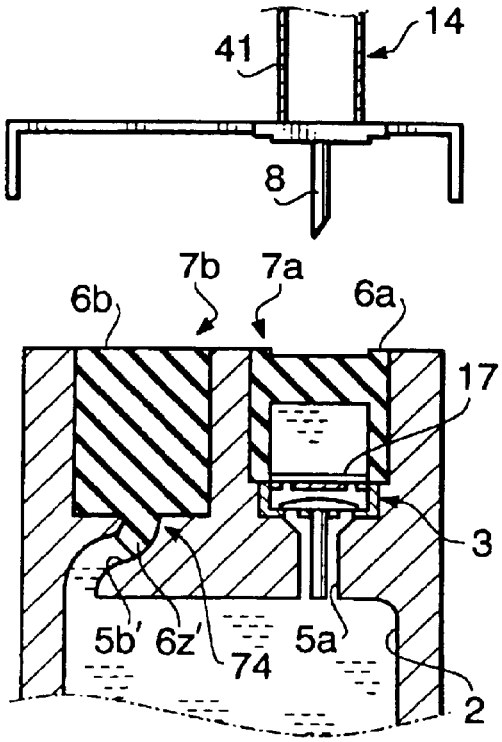

After the ink is filled, the second stop 6*b* is fully inserted in the second opening 7*b* as shown in FIGS. 15C and 15D so that the protrusion 6*z*' is inserted in the second path 5*b*'.

With this configuration, when the protrusion 6*z*' is inserted in the second path 5*b*', the protrusion 6*z*' is deformed or bent, as shown in FIG. 15D, so as to follow the shape of the second path 5*b*'.

Under the condition shown In FIG. 15D, if a user erroneously attempts to penetrate a needle through the second stop 6*b*, it is very difficult to have the needle penetrate through the protrusion 6*z*' since it is compressed and therefore hardened. Therefore, the invasion of the bubbles and impurities due to such an erroneous operation is also avoidable.

Further, if the user erroneously pulls out the second stop 6*b*, the protrusion 6*z*' is cut out at the incision and remains in the second path 5*b*' to prevent the communication with the second opening 7*b*. Therefore, also in this case, the invasion of the bubbles and impurities in the ink reservoir 2 is avoidable. Further, the ink will not spatter when the second stop 6*b* is pulled out of the second opening 7*b*.

It should be noted that forming an incision is an exemplary configuration, and various modification may be considered. What is important is the proximal end of the protrusion 6*z*' is weakened so that the protrusion 6*z*' is easily deformed to follow the curved second path 5*b* when inserted therein, and is easily cut off when the second stop 6*b* is pulled out of the second opening. Accordingly, instead of forming the incision, the proximal end portion may be formed to be thin.

Fourth Embodiment

Figure 16A:
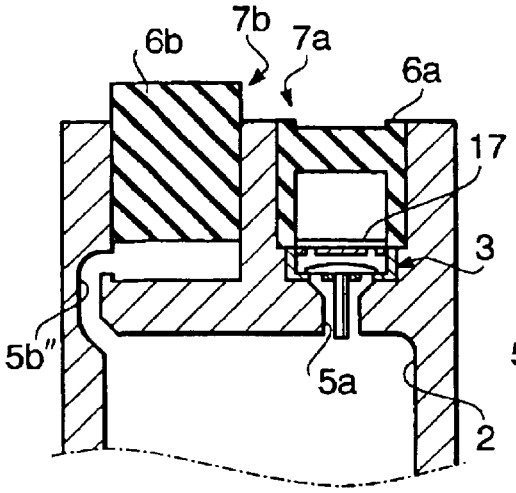
FIGS. 16A–16D show a structure of openings formed on the housing and a rubber stop fitted therein according to a fourth embodiment.

FIGS. 16A through 16D show a structure of the openings 7*a* and 7*b*, and the stops 6*a* and 6*b*, according to a fourth embodiment. According to the fourth embodiment, as shown in FIG. 16A, the second stop 6*b* is not provided with a protrusion, and a second path 5*b*" is configured to communicate with the second opening 7*b* at the side surface thereof. The second path 5*b*" has a curved shape and connects the second opening 7*b* and the ink reservoir 2. In the fourth embodiment, the side surface of the second stop 6*b* functions as a valve to close the second path 5*b*".

Figure 16B:
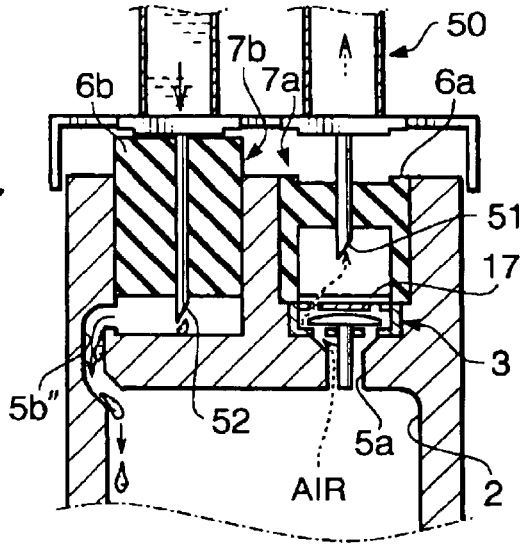

FIG. 16B shows an ink filling operation according to the fourth embodiment. Similarly to the first embodiment, when the ink filling operation is performed, the second stop 6*b* is not completely inserted in the second opening 7*b*, and the second path 5*b*" communicates with the second opening 7*b*. Therefore, the ink can be supplied from the second opening 7*b* to the ink reservoir 2 through the second path 5*b*".

Figure 16C:
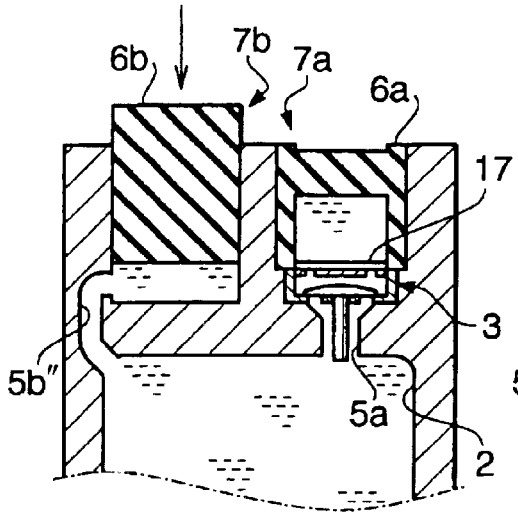
Figure 16D:
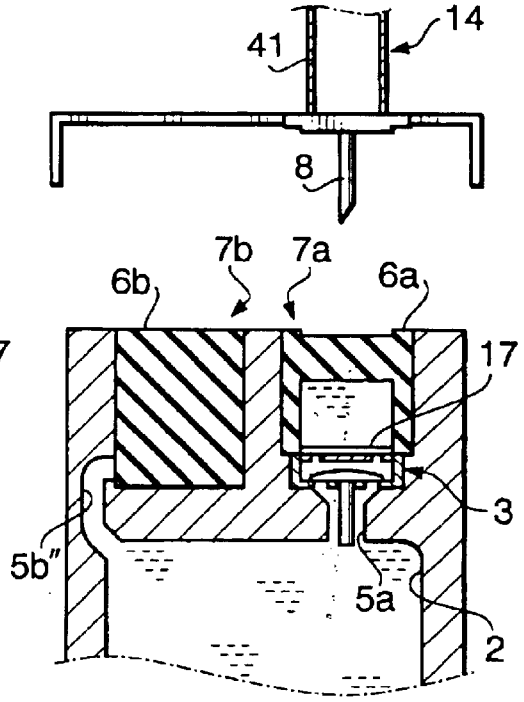

After the ink is filled, the second stop 6*b* is fully inserted in the second opening 7*b* as shown in FIGS. 16C and 16D so that the second path 5*b*" is closed by the side surface of the second stop 6*b*.

As a result, the flow of the ink from the second stop 6*b* side to the ink reservoir 2 is prevented, and therefore, invasion of bubbles and impurities in the ink reservoir 2 is avoidable. Further, under the condition shown in FIG. 16D, if a user erroneously attempts to penetrate a needle through the second stop 6*b* toward the second path 5*b*", it is very difficult to have the needle obliquely penetrate through the second stop 6*b*. Therefore, the invasion of the bubbles and impurities due to such an erroneous operation is also avoidable.

In each of the embodiments, by inserting the second stop 6*b* to an intermediate position, the ink filling operation can be performed. Then, by further inserting the second stop 6*b* (i.e., by further moving the second stop 6*b* in its axial direction) so that the second stop 6*b* is completely fitted in the second opening 7*b*, the communication between the ink reservoir 2 and the second opening 7*b* is disabled, thereby invasion of the bubbles and/or impurities in the ink reservoir 2 can be prevented.

The present disclosure relates to the subject matter contained in Japanese Patent Application No. 2002-214079, filed on Jul. 23, 2002, which is expressly incorporated herein by reference in its entirety.

What is claimed is:

1. An ink cartridge, comprising:

a housing defining a body of said cartridge;

an ink reservoir accommodated in said housing;

an opening formed on said housing, said opening communicating with said ink reservoir through a fluid path, said fluid path communicating with said opening at a decentered position of a bottom surface of said opening;

a stop to be fitted in said opening, said stop having elasticity and being configured such that a hollow needle can be penetrated therethrough; and a valve structure provided to a part of said stop, said valve structure selectively opening and closing the communication between said opening and said ink reservoir, depending on a positional condition of said stop.

2. The ink cartridge according to claim 1, wherein said positional condition of said stop includes a position along an axis of said stop, and said stop is movably located at a first position where said stop is inserted intermediately in said opening and at a second position where said stop is deeply inserted in said opening.

3. The ink cartridge according to claim 2, wherein said valve structure includes a protrusion that is protruded from a bottom surface of said stop at a position corresponding to the decentered position where said opening communicates with said fluid path, said protrusion being fitted in said fluid path when said stop is fully inserted in said opening, said protrusion being spaced from said fluid path when said stop is located at an intermediate position along the axial direction thereof.

4. The ink cartridge according to claim 3, wherein said protrusion has a conical shape.

5. The ink cartridge according to claim 3, wherein said stop includes a barrel member fitted in said opening and a closing wall formed inside said barrel member to partially close said barrel member.

6. The ink cartridge according to claim 5, wherein said hollow needle can be penetrated through said closing member, and said protrusion is formed on an end of said barrel member to correspond to the decentered position.

7. An ink cartridge, comprising:

a housing defining a body of said cartridge;

an ink reservoir accommodated in said housing;

a first opening formed on said housing, said first opening communicating with said ink reservoir through a first fluid path;

a second opening formed on said housing, said second opening communicating with said ink reservoir through a second fluid path, said second fluid path communicating with said second opening at a decentered position of a bottom surface of said second opening;

a first stop to be fitted in said first opening, said first stop having elasticity, said first stop being configured such that a hollow needle can be penetrated therethrough;

a second stop to be fitted in said second opening, said second stop having elasticity, said second stop being configured such that a hollow needle can be penetrated therethrough;

a one-way valve provided between said first opening and said first fluid path, said one-way valve allowing a flow of fluid only in a direction from said ink reservoir to said first opening, the air inside said ink reservoir being evacuated through said first opening;

a valve structure provided to a part of said second stop, said valve structure selectively opening and closing the communication between said second opening and said ink reservoir through said second fluid path depending on a positional condition of said second stop.

8. The ink cartridge according to claim 7, wherein said positional condition of said second stop includes a position along an axis of said second stop, and wherein said second stop is movably located at a first position where said second stop is inserted intermediately in said second opening and at a second position where said second stop is deeply inserted in said second opening.

9. The ink cartridge according to claim 8, further comprising a connection member that connects end portions of said first stop and said second stop, said first stop, said second stop and said connection member forming an integral stop.

10. The ink cartridge according to claim 9, wherein a groove is formed between said first opening and said second opening, said groove being configured such that said connection member is fitted in said groove, a surface of said housing where said first and second openings are formed being substantially planar when said first stop and said second stop are fully inserted in said first opening and said second opening, respectively, and said connection member is fitted in said groove.

11. The ink cartridge according to claim 10, further including a protection film, said protection film being adhered on the surface where said first opening and said second opening are formed to cover said first opening and said second opening with said first stop, said second stop and said connection member fitted in said first opening, said second opening and said groove, respectively.

12. The ink cartridge according to claim 11, wherein opposing end portions of said protection film being bent toward said housing to define bent portions, said housing being formed with grooves capable of receiving said bent portions, said bent portions being accommodated in said grooves when said protection film is adhered on the surface where said first opening and said second opening are formed.

13. A method of filling an ink in an ink reservoir accommodated in an ink cartridge, the ink cartridge including a housing defining a body of the cartridge, an opening being formed on the housing, the opening communicating with the ink reservoir through a fluid path, the fluid path communicating with the opening at a decentered position of a bottom surface of the opening, a stop being provided to be fitted in the opening, the stop having elasticity, the stop being configured such that a hollow needle can be penetrated therethrough, a valve structure being provided to a part of the stop, the valve structure selectively opening and closing the communication between the opening and the ink reservoir depending on a positional condition of the stop, the method comprising:

locating the stop at a position where the valve structure is opened;

penetrating a hollow needle;

supplying the ink to the ink reservoir through the hollow needle;

removing the hollow needle from the stop; and locating the stop at a position where the valve structure is closed.

14. The method according to claim 13, wherein the positional condition of the stop includes a position along an axis of the stop, and wherein the stop is movably located at a first position where the stop is inserted intermediately in the opening and at a second position where the stop is deeply inserted in the opening.

15. An ink cartridge, comprising:

a housing defining a body of the cartridge;

an ink reservoir accommodated in the housing;

an opening formed in the housing, the opening communicating with the ink reservoir through a fluid path; and a stop fitted in the opening, the stop having elasticity and being formed of a material such that when a hollow needle is penetrated through the stop, a hole fanned by penetration of the hollow needle is closed by the elasticity of the stop after the hollow needle is removed;

wherein the stop is moveable between a first position permitting communication between the opening and the fluid path, and a second position in which the stop substantially obstructs communication between the opening and the fluid path.

16. The ink cartridge of claim 15, wherein when the stop is in the first position, a fluid can be administered into an area of the opening between the stop and the fluid path using a hollow needle.

17. The ink cartridge of claim 15, wherein when the stop is in the second position, a fluid cannot be administered into an area of the opening between the stop and the fluid path using a hollow needle.

18. The ink cartridge of claim 15, wherein when the stop is in the first position, the stop is inserted intermediately in the opening, and when the stop is in the second position, the stop is deeply inserted in the opening.

19. The ink cartridge of claim 15, wherein when the stop is in the opening, the stop prevents air from entering the ink reservoir.

20. The ink cartridge of claim 15, wherein when the stop is in the opening, the stop prevents impurities from entering the ink reservoir.

21. The ink cartridge of claim 15, wherein the fluid path communicates with the opening at a position that prevents insertion of a hollow needle through the opening and into the fluid path.

22. The ink cartridge of claim 15, wherein the fluid path communicates with the opening at an inner side surface of the opening.

23. The ink cartridge of claim 15, wherein the opening has a substantially cylindrical shape.

24. The ink cartridge of claim 15, wherein the stop has a substantially cylindrical shape.

* * * * *